US008783859B2

(12) United States Patent
Tokisawa et al.

(10) Patent No.: US 8,783,859 B2
(45) Date of Patent: Jul. 22, 2014

(54) SHEET CONVEYANCE APPARATUS, PRINTING APPARATUS, AND JAM CLEARING METHOD

(71) Applicant: Canon Kabushiki Kaisha, Tokyo (JP)

(72) Inventors: Toshiaki Tokisawa, Kawasaki (JP); Yoshiaki Suzuki, Nagareyama (JP); Kanto Kurasawa, Kawasaki (JP); Masahito Yoshida, Shiki (JP); Kota Uchida, Kawasaki (JP); Takayuki Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/653,806

(22) Filed: Oct. 17, 2012

(65) Prior Publication Data

US 2013/0100219 A1 Apr. 25, 2013

(30) Foreign Application Priority Data

Oct. 21, 2011 (JP) ..... 2011-231517

(51) Int. Cl.
*B41J 2/01* (2006.01)

(52) U.S. Cl.
USPC ..... 347/104

(58) Field of Classification Search
USPC ..... 347/5, 14, 16, 102, 104; 271/3.15, 3.17; 399/16, 21; 400/614, 625, 582
See application file for complete search history.

(56) References Cited

U.S. PATENT DOCUMENTS

| | | | | |
|---|---|---|---|---|
| 5,027,160 | A | 6/1991 | Okada et al. | |
| 5,153,655 | A | 10/1992 | Suzuki et al. | |
| 5,157,444 | A | 10/1992 | Mori et al. | |
| 5,745,661 | A | 4/1998 | Koh et al. | |
| 6,027,269 | A | 2/2000 | Yoshida | |
| 6,113,093 | A | 9/2000 | Morinaga et al. | |
| 6,725,770 | B2 * | 4/2004 | Maeda | 101/129 |
| 7,018,120 | B2 * | 3/2006 | Takagi | 400/582 |
| 8,025,287 | B2 | 9/2011 | Okamoto | |
| 8,251,364 | B2 | 8/2012 | Morinaga et al. | |
| 8,371,672 | B2 * | 2/2013 | Kusakabe | 347/14 |
| 8,526,839 | B2 * | 9/2013 | Fujinaga | 399/81 |
| 2011/0133397 | A1 | 6/2011 | Shimmachi et al. | |
| 2012/0093554 | A1 | 4/2012 | Suzuki | |
| 2012/0181744 | A1 | 7/2012 | Suzuki | |

FOREIGN PATENT DOCUMENTS

| | | |
|---|---|---|
| JP | H08-259100 | 10/1996 |

* cited by examiner

*Primary Examiner* — Anh T. N. Vo
(74) *Attorney, Agent, or Firm* — Fitzpatrick, Cella, Harper & Scinto

(57) ABSTRACT

A sheet conveyance apparatus comprising: a first processing unit including a first sheet conveyance mechanism; a second processing unit including a second sheet conveyance mechanism; a cutting unit, interposed between the first processing unit and the second processing unit, for cutting the sheet; and a controlling unit that controls, in a case of trouble with sheet conveyance, driving of the first sheet conveyance mechanism until an end of the sheet reaches the first processing unit side beyond a cutting position of the cutting unit.

15 Claims, 17 Drawing Sheets

SHEET CONVEYANCE APPARATUS, PRINTING APPARATUS, AND JAM CLEARING METHOD

BACKGROUND OF THE INVENTION

1. Field of the Invention

The present invention relates to a sheet conveyance apparatus using a continuous sheet, a printing apparatus, and a jam clearing method in these apparatuses.

2. Description of the Related Art

There has been conventionally known a configuration, in which a continuous sheet can be readily removed in the case of occurrence of a jam in an apparatus that is provided with a plurality of conveying units, for subjecting the sheet to printing. For example, Japanese Patent Application Laid-open No. H8-259100 (1996) proposes a configuration, in which when a jam is detected in a first sheet conveying unit, a second sheet conveying unit is released from its sheet conveying operation, and then, the first sheet conveying unit stops its sheet conveying operation whereas the sheet is conveyed in a direction reverse to a conveyance direction by a predetermined distance.

SUMMARY OF THE INVENTION

An apparatus provided with a plurality of sheet conveying units is conceived to have a configuration including a first sheet conveying unit, a second sheet conveying unit, and a sheet cutting device interposed between the first sheet conveying unit and the second sheet conveying unit. In this configuration, when the sheet cutting device is operated in the case where there is a sheet between the two units, a small sheet piece is produced in the vicinity of an inlet of the second sheet conveying unit according to the status of the sheet, and then, falls inside of the apparatus. Once the sheet piece falls down, it is hard to discharge it from the apparatus.

An object of the present invention is to, even if a sheet cutting unit is operated, make a sheet piece hardly remain inside of a sheet conveyance apparatus irrespective of stoppage of sheet conveyance caused by a jam in the apparatus provided with the sheet cutting unit between adjacent units.

A sheet conveyance apparatus comprising: a first processing unit including a first sheet conveyance mechanism; a second processing unit including a second sheet conveyance mechanism; a cutting unit, interposed between the first processing unit and the second processing unit, for cutting the sheet; and a controlling unit that controls, in a case of trouble with sheet conveyance, driving of the first sheet conveyance mechanism until an end of the sheet reaches the first processing unit side beyond a cutting position of the cutting unit.

According to the present invention, a sheet piece hardly remains inside of the apparatus irrespective of stoppage of sheet conveyance caused by a jam when a sheet is cut.

Further features of the present invention will become apparent from the following description of an exemplary embodiment with reference to the attached drawings.

DESCRIPTION OF THE EMBODIMENTS

A best mode for carrying out the present invention will be described with reference to the attached drawings.

Preferred Embodiment

A description will be given below of a printing apparatus using an ink jet system in a preferred embodiment. The printing apparatus in the preferred embodiment is a high speed line printer that uses an elongated, continuous sheet (i.e., a continuous sheet greater in length than a repetitive print unit (hereinafter referred to as one page or a unit image) in a conveyance direction) and is adapted for both of simplex printing and duplex printing. For example, the high speed line printer is suitable for printing a large number of sheets in a print laboratory or the like. In the specification herein, even though a plurality of small images, characters, and blanks exist, in combination, within an area of one print unit (i.e., one page), they are referred to as one unit image. In other words, a unit image signifies a single print unit (i.e., one page) when a plurality of pages are sequentially printed on a continuous sheet. The length of a unit image depends upon the size of the image to be printed. For example, the length of a photograph of an L size is 135 mm in a sheet conveyance direction; and the length of an A4 size is 297 mm in a sheet conveyance direction.

The present invention is widely applicable to printing apparatuses such as a printer, a multifunction printer, a copying machine, a facsimile, and a fabricating apparatus for various devices. Printing may be performed by using any system such as an ink jet system, an electrophotographic system, a thermal transfer system, a dot impact system, or a liquid development system. Moreover, the present invention is applicable to a sheet processing apparatus for performing not only printing but also various kinds of processing (recording, converting, coating, irradiating, reading, inspecting, and the like) on a roll of sheet.

Figure 1:
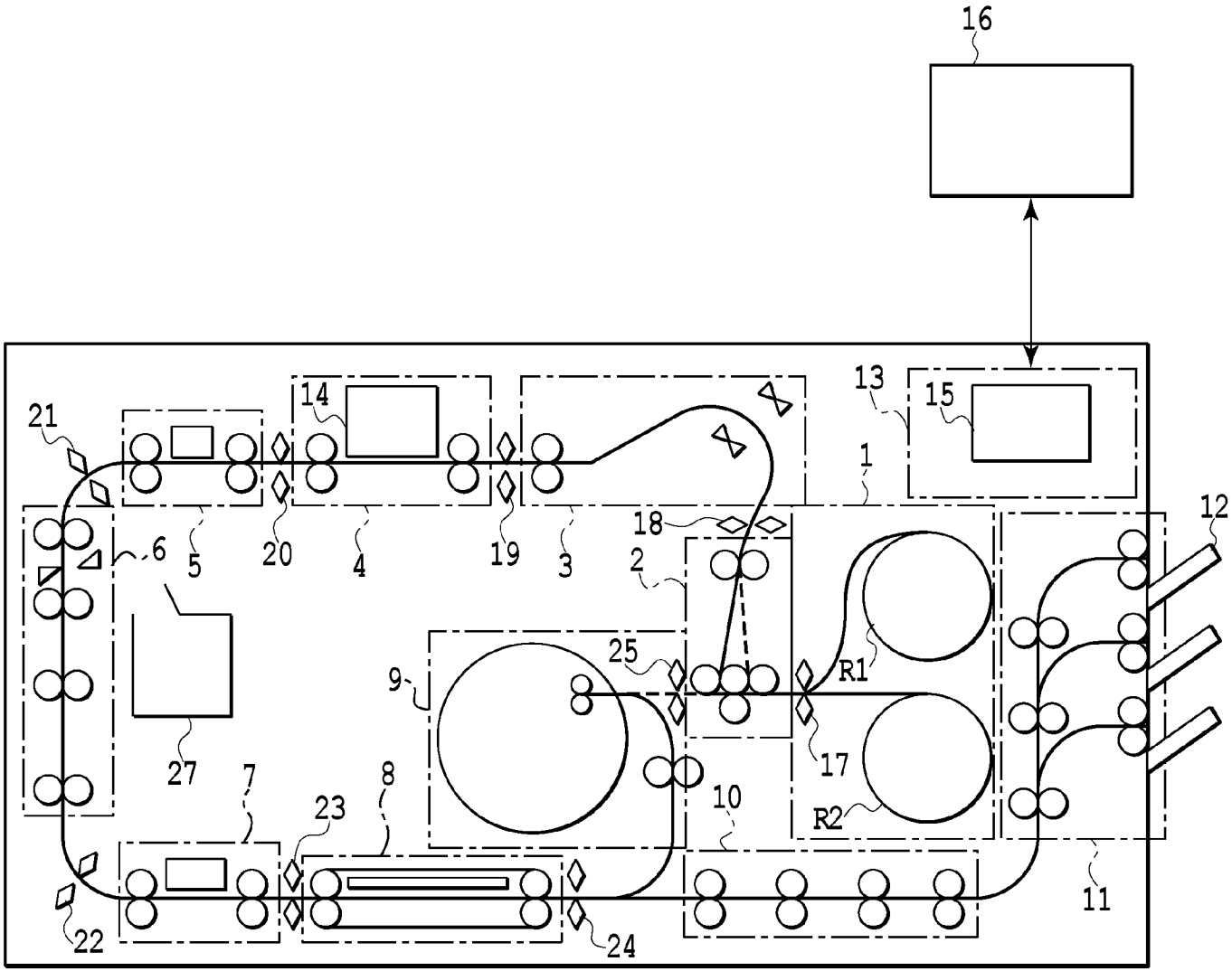
FIG. 1 is a view schematically showing the inside configuration of a printing apparatus.

FIG. 1 is a view schematically showing the inside configuration of a printing apparatus. The printing apparatus in the present preferred embodiment can subject a sheet wound in a roll to duplex printing on both of a first surface of the sheet and a second surface on the back of the first surface. A printing apparatus body is provided with processing units such as a sheet feeding unit 1, a de-curling unit 2, a skewing correcting unit 3, a printing unit 4, an inspecting unit 5, a cutting unit 6, an information recording unit 7, a drying unit 8, a reversing unit 9, a discharging/conveying unit 10, a sorting unit 11, a discharging unit 12, and a controlling unit 13. These processing units are incorporated in a casing for the apparatus body. At the front surface of the casing (i.e., in the direction normal to the surface of the page of FIG. 1) are provided a plurality of maintenance doors that can be independently opened or closed. A sheet is conveyed along a sheet conveyance path indicated by a solid line in FIG. 1 by a sheet conveyance mechanism including roller pairs and belts, to be thus subjected to the processing in each of the processing units. At an arbitrary position on the sheet conveyance path, a side near the sheet feeding unit 1 is referred to as "upstream": in contrast, the opposite side is referred to as "downstream."

The sheet feeding unit 1 is adapted to hold and feed the continuous sheet wound in a roll. The sheet feeding unit 1 can accommodate two rolls R1 and R2 and is configured to draw and feed a sheet from either one of the rolls. Here, the number of rolls that can be accommodated is not limited to two but may be one or three or more. Moreover, the sheet is not limited to the sheet wound in a roll as long as the sheet is of a continuous type. For example, a continuous sheet having perforations per unit length may be folded on each line of perforations and stacked to be thus contained in the sheet feeding unit 1.

The de-curling unit 2 is designed to reduce curl (i.e., a warp) of a sheet fed from the sheet feeding unit 1. The de-curling unit 2 allows the sheet to pass therethrough in a curve in such a manner as to apply a warp reverse to the curl with the application of a de-curling force by using a couple of pinch rollers with respect to a single drive roller, thereby reducing the curl. The de-curling unit 2 can adjust the de-curling force, as described later.

The skewing correcting unit 3 is adapted to correct skewing (an inclination with respect to an original advance direction) of the sheet having passed the de-curling unit 2. The end of the sheet on a reference side is pressed against a guide member, and therefore, the sheet skewing is corrected.

The printing unit 4 is adapted to subject the sheet conveyed to printing by a printing head 14 from above, thereby forming an image on the sheet. That is to say, the printing unit 4 is a processor for subjecting the sheet to predetermined processing. The printing unit 4 is provided also with a plurality of conveyance rollers for conveying the sheet. The printing unit 4 includes a line type printing head having a nozzle array of an ink jet system within a range that covers a maximum width of a sheet to be used. The printing head 14 includes a plurality of heads juxtaposed in a conveyance direction. In the present preferred embodiment, there are seven heads corresponding to C (cyan), M (magenta), Y (yellow), LC (light cyan), LM (light magenta), G (gray), and K (black) colors. Here, the number of colors and the number of heads are not limited to seven. A system using heat generating elements, a system using piezoelectric elements, a system using electrostatic elements, a system using MEMS elements, and the like can be adopted as the ink jet system. Ink of each of the colors is supplied to the printing head 14 through an ink tube from an ink tank.

The inspecting unit 5 is designed to optically scan an inspection pattern or an image printed on the sheet in the printing unit 4 so as to inspect the state of the nozzles in the printing head, a sheet conveyance state, an image position, and the like, thereby determining whether or not the image has been accurately printed. A scanner includes a CCD image sensor or a CMOS image sensor.

The cutting unit 6 is adapted to cut a sheet, and is provided with a mechanically automatic cutter for cutting the printed sheet in a predetermined length by the drive force of a motor. In the present preferred embodiment, a description will be given below of an automatic cutter exemplifying the cutting unit 6. The cutting unit 6 includes also a plurality of conveyance rollers for feeding out the sheet to a next process. A trash box 27 is disposed in the vicinity of the cutting unit 6. The trash box 27 is designed to accommodate a small sheet piece that is cut down in the cutting unit 6 and discharged as trash. The cutting unit 6 further includes a distributing mechanism for discharging the cut sheet to the trash box 27 or transferring it onto an original conveyance path.

The information recording unit 7 is designed to record print information (i.e., inherent information) such as a serial number or a date of a printout in a non-print region of the cut sheet. Specifically, letters or codes are printed by an ink jet system or a thermal transfer system.

The drying unit 8 is designed to heat the sheet printed in the printing unit 4 so as to dry the applied ink in a short period of time. Inside of the drying unit 8, hot air is blown to at least an ink applied surface, that is, the lower side of the passing sheet, thereby drying the ink applied surface.

A sheet conveyance path from the sheet feeding unit 1 to the drying unit 8 is referred to as a first path. The first path is formed into a U shape from the printing unit 4 to the drying unit 8 inside of the printing apparatus, wherein the cutting unit 6 is located in the middle of the U shape.

The reversing unit 9 temporarily winds the continuous sheet that has been subjected to obverse printing during a duplex printing operation so as to reverse the sheet. The reversing unit 9 is disposed on the way of a path from the drying unit 8 to the printing unit 4 through the de-curling unit 2 (i.e., a loop path) (hereinafter referred to as a second path), thereby feeding the sheet having passed the drying unit 8 to the printing unit 4 again. The reversing unit 9 includes a winding rotary member (i.e., a drum) that winds and accommodates the sheet. The continuous sheet that has been subjected to the obverse printing but has not been cut is temporarily wound around and accommodated in the winding rotary member. After the sheet is wound, the winding rotary member is reversely rotated, and then, the wound sheet is fed to the de-curling unit 2, and further, to the printing unit 4. This sheet is turned upside down, and therefore, its reverse can be subjected to printing in the printing unit 4. The duplex printing operation will be specifically described later.

The discharging/conveying unit 10 is adapted to convey the sheet that has been cut in the cutting unit 6 and dried in the drying unit 8, and then, to deliver the sheet to the sorting unit 11. The discharging/conveying unit 10 is disposed on a path (hereinafter referred to as a third path) different from the second path, on which the reversing unit 9 is disposed. In order to selectively guide the sheet conveyed on the first path onto either one of the second path and the third path, a path switching mechanism having a movable flap is disposed at a branching position between the paths.

The sorting unit 11 and the discharging unit 12 are disposed at the side of the sheet feeding unit 1 and at the end of the third path. The sorting unit 11 is adapted to sort the printed sheets into groups, as required. The sorted sheets are discharged to the discharging unit 12 including a plurality of trays. In this manner, the third path has a layout in which the sheet is discharged under the sheet feeding unit 1 onto a side opposite to the printing unit 4 and the drying unit 8 with respect to the sheet feeding unit 1 inside of the printing apparatus.

As described above, the sheet feeding unit 1 through the drying unit 8 are disposed in order on the first path. After the drying unit 8, the path is branched into the second path and the third path. The reversing unit 9 is disposed on the way of the second path, which is then converged with the first path. The discharging unit 12 is disposed at the end of the third path.

The de-curling unit 2, the skewing correcting unit 3, the printing unit 4, the inspecting unit 5, the cutting unit 6, the information recording unit 7, the drying unit 8, and the discharging/conveying unit 10 are processing units independent of each other. For the sake of easy maintenance in a jam clearing operation or the like, an operator can manually draw an arbitrary unit of the printing apparatus body forward in an independently detachable manner.

In each of the units, cutters for cutting the continuous sheet are provided upstream and downstream of the sheet conveyance path in the vicinity of the unit. The operator can cut the sheet by using the cutter upstream or downstream in the vicinity of the unit to be drawn during the jam clearing operation, and thus, can readily draw the unit. The cutter is of a hand type to be manipulated by the operator, and is driven by the manual force of the operator or an actuator according to an instruction by the operator. As shown in FIG. 1, all of first to ninth hand cutters 17 to 25 are disposed at nine positions on the sheet conveyance path inside of the apparatus. Namely, the first cutter 17 is interposed between the sheet feeding unit 1 and the de-curling unit 2. In the same manner, the second cutter 18 is interposed between the de-curling unit 2 and the skewing correcting unit 3; the third cutter 19, between the skewing correcting unit 3 and the printing unit 4; the fourth cutter 20, between the printing unit 4 and the inspecting unit 5; and the fifth cutter 21, between the inspecting unit 5 and the cutting unit 6. Downstream of the cutting unit 6, the sixth cutter 22 is interposed between the cutting unit 6 and the information recording unit 7; the seventh cutter 23 is interposed between the information recording unit 7 and the drying unit 8; and the eighth cutter 24 is disposed downstream in the vicinity of the drying unit 8. The ninth cutter 25 is interposed between the reversing unit 9 and the de-curling unit 2. No continuous sheet is conveyed downstream of the discharging/conveying unit 10, and therefore, no cutter for cutting the continuous sheet need be disposed.

The controlling unit 13 is responsible for controlling each of the units in the entire printing apparatus. The controlling unit 13 includes a controller including a CPU, storages, and various control parts, an outside interface, and an operating panel 15, through which the operator inputs and outputs data. The operation of the printing apparatus is controlled in response to an instruction from the controller or a host apparatus 16 such as a host computer connected to the controller via the outside interface.

Figure 2:
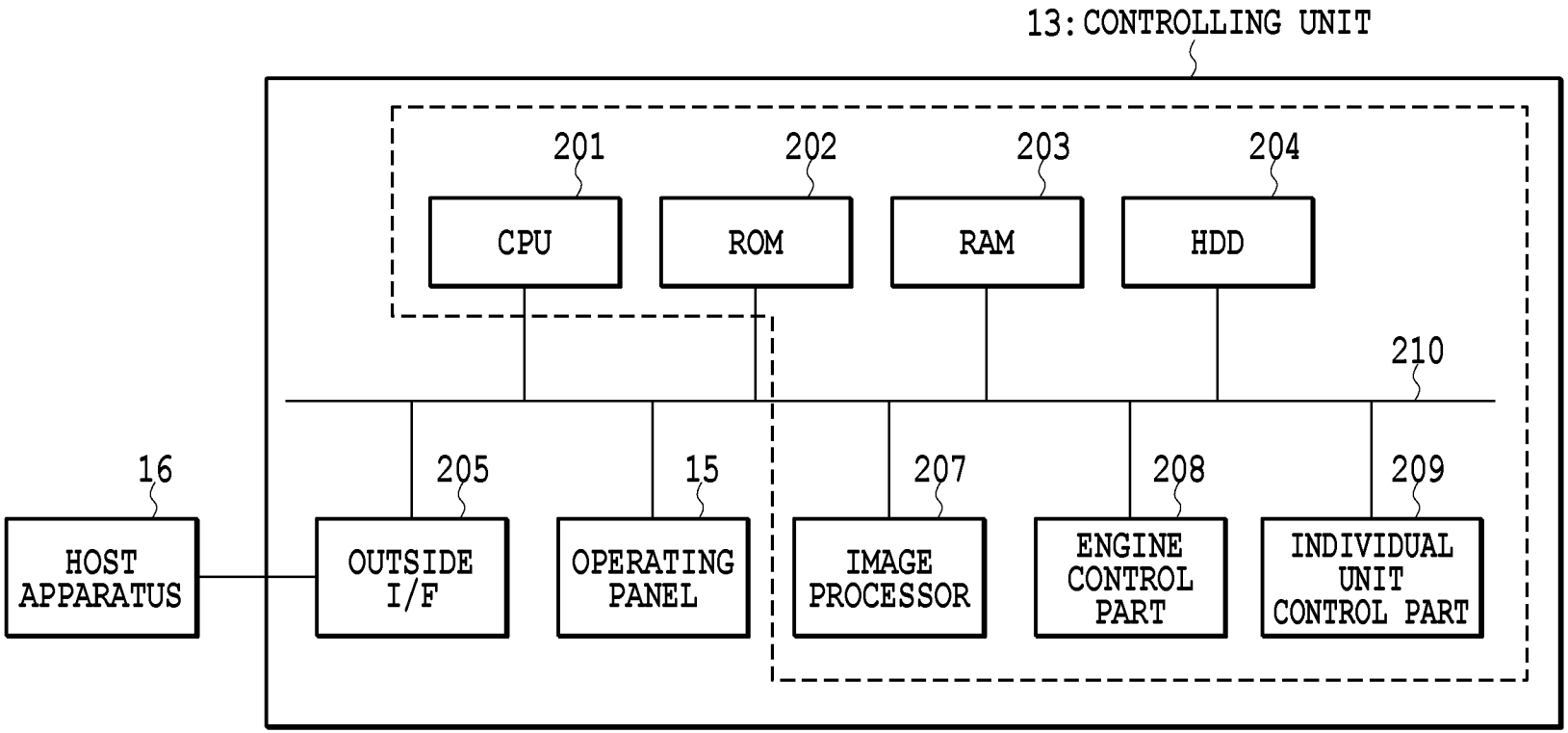
FIG. 2 is a block diagram illustrating the idea of a controlling unit.

FIG. 2 is a block diagram illustrating the idea of the controlling unit 13. The controller (surrounded by a broken line) included in the controlling unit 13 is constituted of a CPU 201, a ROM 202, a RAM 203, an HDD 204, an image processor 207, an engine control part 208, and an individual unit control part 209. The CPU (abbreviating a central processing unit) 201 comprehensively controls the operation of each of the units in the printing apparatus. The ROM 202 stores therein programs to be executed by the CPU 201 and stationary data required for various operations in the printing apparatus. The RAM 203 is used as a work area for the CPU 201, a temporary storage area for various received data, or a storage area for various setting data. The programs to be executed by the CPU 201, print data, and setting information required for various operations in the printing apparatus can be stored in and read out from the HDD (abbreviating a hard disk drive) 204. The operating panel 15 serves as an input/output interface with respect to the operator, and includes an input such as a hard key or a touch panel and an output such as a display presenting information or a voice generator.

The units requiring quick data processing include dedicated processors. The image processor 207 performs image processing of the print data to be processed in the printing apparatus. The image processor 207 converts the color space (e.g., YCbCr) of the input image data into a standard RGB color space (e.g., sRGB). Moreover, the image processor 207 subjects the image data to various kinds of image processing such as resolution conversion, an image analysis, and image correction, as required. The print data resulting from the image processing is stored in the RAM 203 or the HDD 204. The engine control part 208 controls driving of the printing head 14 in the printing unit 4 according to the print data in response to a control command output from the CPU 201 or the like. The engine control part 208 further controls a sheet conveyance mechanism in each of the units inside of the printing apparatus. The individual unit control part 209 serves as a sub controller for individually controlling each of the sheet feeding unit 1, the de-curling unit 2, the skewing correcting unit 3, the inspecting unit 5, the cutting unit 6, the information recording unit 7, the drying unit 8, the reversing unit 9, the discharging/conveying unit 10, the sorting unit 11, and the discharging unit 12. The individual unit control part 209 controls the operation of each of the units in response to an instruction from the CPU 201. The outside I/F 205 is a local or network interface (abbreviated as I/F) for connecting the controller to the host apparatus 16. The above-described constituent elements are connected to each other via a system bus 210.

The host apparatus 16 functions as a source for supplying image data for allowing the printing apparatus to perform a printing operation. The host apparatus 16 may be a versatile or dedicated computer or dedicated image equipment such as an image capture having an image reader unit, a digital camera, and a photo storage. When the host apparatus 16 is a computer, the OS, application software for producing image data, and a printing apparatus driver for the printing apparatus are installed in a storage device included in the computer. Software need not implement all of the above-described processing, but hardware may implement some or all of the above-described processing.

Next, a description will be given of basic printing operations. The printing operations are performed in a simplex print mode and a duplex print mode. The operations in the simplex print mode and the duplex print mode are different from each other, and therefore, explanation will be individually made on the operations in the modes.

In the simplex print mode, the obverse (i.e., a first side) of the sheet that has been fed from the sheet feeding unit 1 and processed in each of the de-curling unit 2 and the skewing correcting unit 3 is subjected to the printing in the printing unit 4. Images, each having a predetermined unit length in a conveyance direction, (i.e., unit images) are subsequently printed on the elongated continuous sheet, and thus, a plurality of images are formed in arrangement. The printed sheet passes the inspecting unit 5, and then, is cut per unit image in the cutting unit 6. The print information is recorded on the reverse of each of the cut sheets in the information recording unit 7, as required. The cut sheets are conveyed one by one to the drying unit 8, followed by drying. Thereafter, the cut sheets pass the discharging/conveying unit 10 and the sorting unit 11, and then, are sequentially discharged to and stacked on the discharging unit 12. In the meantime, the sheet that remains in the printing unit 4 after cutting off the printed sheet having the last unit image is returned to the sheet feeding unit 1, and then, is wound around the roll R1 or R2. In this manner, in the simplex print mode, the sheet is processed on the first path and the third path, but does not pass the second path.

On the other hand, in the duplex print mode, a reverse (i.e., a second side) print sequence follows the obverse (i.e., the first side) print sequence. The respective operations in the sheet feeding unit 1 to the inspecting unit 5 in the preceding obverse print sequence are identical to those in the above-described simplex print mode. The continuous sheet is not cut in the cutting unit 6, and therefore, it is conveyed to the drying unit 8 as it is continuous. After the ink applied onto the obverse is dried in the drying unit 8, the sheet is guided not onto the path on the side of the discharging/conveying unit 10 (i.e., the third path) but onto the path on the side of the reversing unit 9 (i.e., the second path). The sheet is wound around the winding rotary member in the reversing unit 9 that is rotated forward (i.e., counterclockwise in FIG. 1) on the second path. Upon completion of all of the planned printing operations on the obverse in the printing unit 4, the trailing end of the printing region of the continuous sheet is cut in the cutting unit 6. The entire continuous sheet downstream in the conveyance direction (i.e., the printed side) with reference to the cut position is wound up to the trailing end (i.e., the cut position) in the reversing unit 9 through the drying unit 8. At the same time when the sheet is wound in the reversing unit 9, the continuous sheet remaining upstream in the conveyance direction (i.e., on the side of the printing unit 4) with reference to the cut position is returned to the sheet feeding unit 1 in such a manner that the leading end (i.e., the cut position) of the sheet does not remain in the de-curling unit 2, and then, is wound around the roll R1 or R2. This return (i.e., back feeding) prevents the sheet from colliding against the sheet that is fed again in the following reverse print sequence.

The above-described obverse print sequence is switched to the reverse print sequence. The winding rotary member in the reversing unit 9 is rotated in a direction reverse to that at the time of winding (clockwise in FIG. 1). The end of the wound sheet (the trailing end of the sheet during winding serves as the leading end of the sheet during feeding) is fed into the de-curling unit 2 along a path indicated by a broken line in FIG. 1. The de-curling unit 2 corrects curl that has been exerted on the sheet by the winding rotary member. In other words, the de-curling unit 2 is positioned between the sheet feeding unit 1 and the printing unit 4 on the first path, and between the reversing unit 9 and the printing unit 4 on the second path. Thus, the de-curling unit 2 is common between both paths. The reversed sheet is fed to the printing unit 4 through the skewing correcting unit 3, and then, is subjected to printing on the reverse thereof. The printed sheet is cut per predetermined unit length in the cutting unit 6. The images are printed on both sides of the cut sheet, and therefore, the information recording unit 7 does not record any information. The cut sheets are conveyed one by one to the drying unit 8, and then, are sequentially discharged to and stacked on the discharging unit 12 through the discharging/conveying unit 10 and the sorting unit 11. In this manner, the sheet is processed on the first path, the second path, the first path, and the third path in this order in the duplex print mode.

Figure 3:
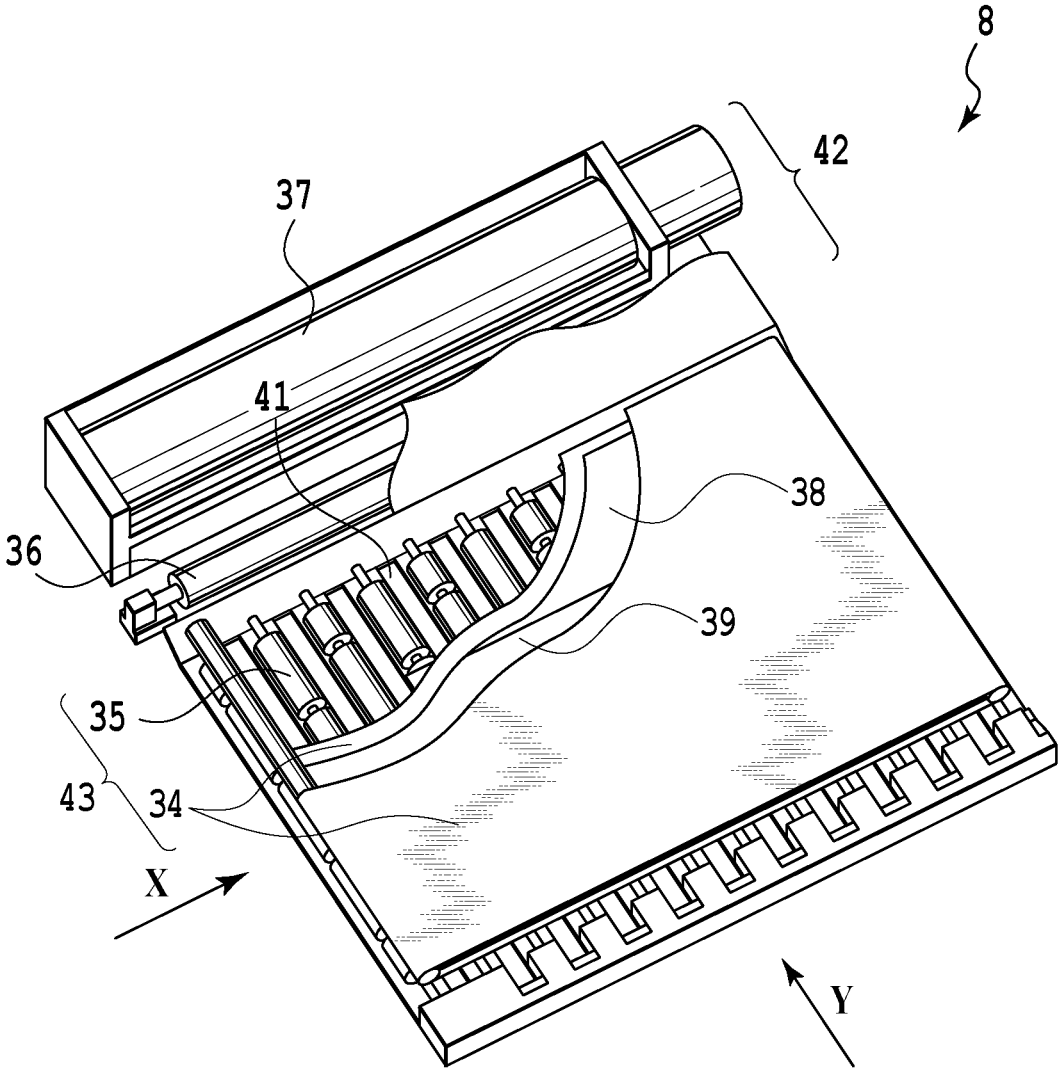
FIG. 3 is a perspective view showing the inside structure of a drying unit.

Subsequently, detailed explanation will be made on the drying unit 8 in the printing apparatus having the above-described configuration. FIG. 3 is a perspective view showing the inside structure of a casing in the drying unit 8. The sheet conveyed with the application of the ink in the printing unit 4 is guided to the drying unit 8 in a direction indicated by an arrow X in FIG. 3 through the cutting unit 6 and the information recording unit 7. The drying unit 8 includes a heating unit 42 and a conveying unit 43. The conveying unit 43 is provided with an endless belt, or a conveyance belt 34, to which a rotational drive force is applied, a plurality of conveyance rollers 35 and driven rollers that are arranged in the conveyance direction oppositely to the conveyance belt 34. An interval between the adjacent conveyance rollers 35 is shorter than the length of a smallest cut sheet. No matter whether the sheet guided to the drying unit 8 is of a continuous type or a cut type, the sheet smoothly travels inside of the drying unit 8 while being held between the conveyance belt 34 and the conveyance rollers 35.

The heating unit 42 is adapted to circulate hot air inside of the casing of the drying unit 8 so as to blow the hot air against the sheet. The heating unit 42 is provided with a heater 36 for increasing the temperature of air (i.e., heating the air) so as to produce the hot air and a fan 37 for circulating the hot air so as to blow the hot air against the sheet. The hot air blown by the fan 37 is jetted upward from spaces 41 defined below the conveyance rollers 35, and then, sprayed onto the sheet. Thereafter, the hot air is returned to the fan 37, and then, is circulated inside of the casing.

A heat transmitting plate 38 and a planar heat generator 39 that are integrated with each other are disposed inside of the conveyance belt 34. Heat generated in the planar heat generator 39 is transmitted to the heat transmitting plate 38 serving as a thermal conductor. When the conveyance belt 34 is turned, the inside surface of the conveyance belt 34 slides in surface contact with the surface of the heat transmitting plate 38. The contact enables the heat to be transmitted from the heat transmitting plate 38 to the conveyance belt 34, thereby increasing the temperature of the entire conveyance belt 34. Since the sheet is heated in surface contact with the outside surface of the conveyance belt 34 when the sheet is conveyed inside of the drying unit 8, the drying of the sheet is promoted. That is to say, the hot air is blown toward the obverse (i.e., the ink applied side) in the heating unit 42 and the heat is applied to the reverse by the conveyance belt 34, and therefore, the sheet is heated from both sides to be thus dried with high efficiency.

Figure 4A:
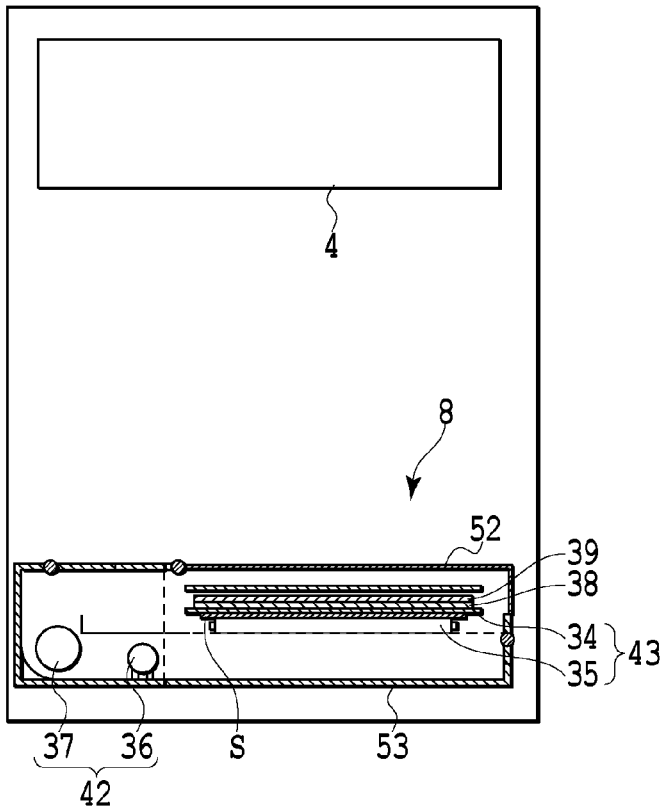
FIG. 4A is a cross-sectional view showing a printing apparatus body.
Figure 4B:
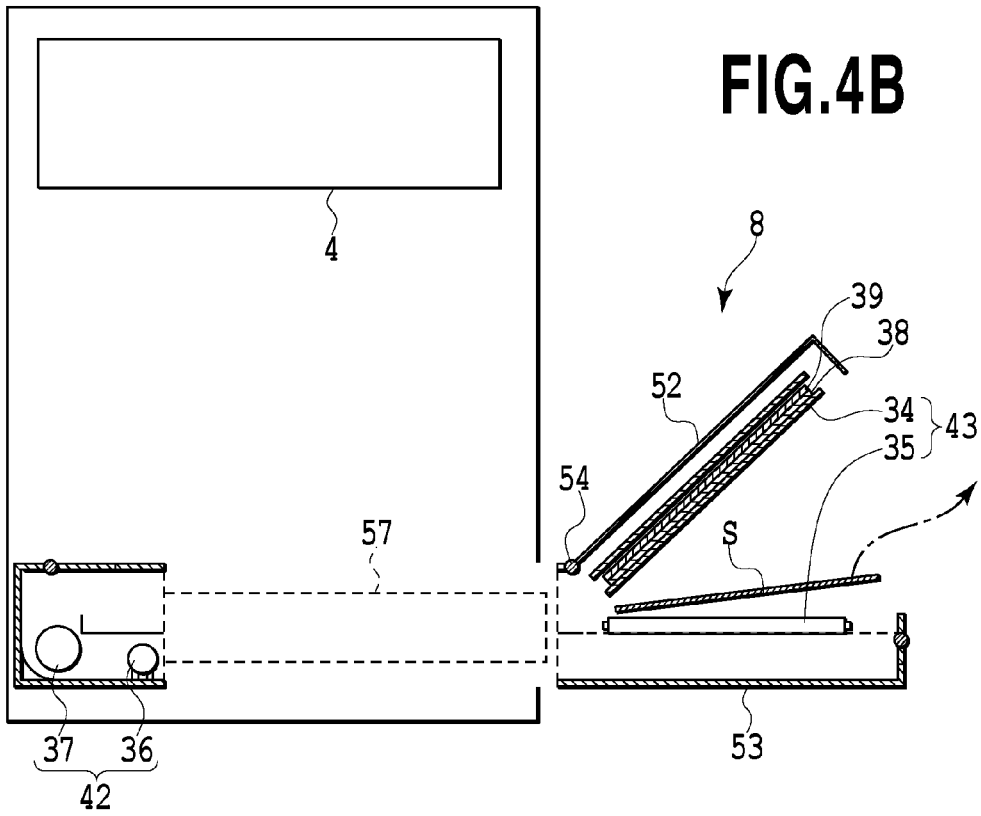
FIG. 4B is another cross-sectional view showing the printing apparatus body.

FIGS. 4A and 4B are cross-sectional views showing the printing apparatus body, taken along a line passing the printing unit 4 and the drying unit 8. The drying unit 8 includes the casing constituted of a first casing constituent 52 (i.e., an upper cover) and a second casing constituent 53 (i.e., a casing principal part). Inside of the casing are housed the heating unit 42 and the conveying unit 43. The heating unit 42 and a part (i.e., the conveyance rollers) of the conveying unit 43 are held in the second casing constituent 53. The first casing constituent 52 and the second casing constituent 53 are designed to be opened or closed on a hinge 54 serving as a fulcrum. FIG. 4A shows the state in which the units are housed inside of the printing apparatus body and the first casing constituent 52 is closed: in contrast, FIG. 4B shows the state in which the first casing constituent 52 is opened in the drying unit 8. A part of the drying unit 8 is slidably moved along a rail 57 disposed inside of the printing apparatus body, and then, is drawn forward (i.e., toward the operator) from the printing apparatus. When the drying unit 8 is drawn, as shown in FIG. 4B, a unit including the conveying unit 43 and a unit including the heating unit 42 are detached from each other, and thus, the heating unit 42 remains inside of the printing apparatus body.

Figure 5:
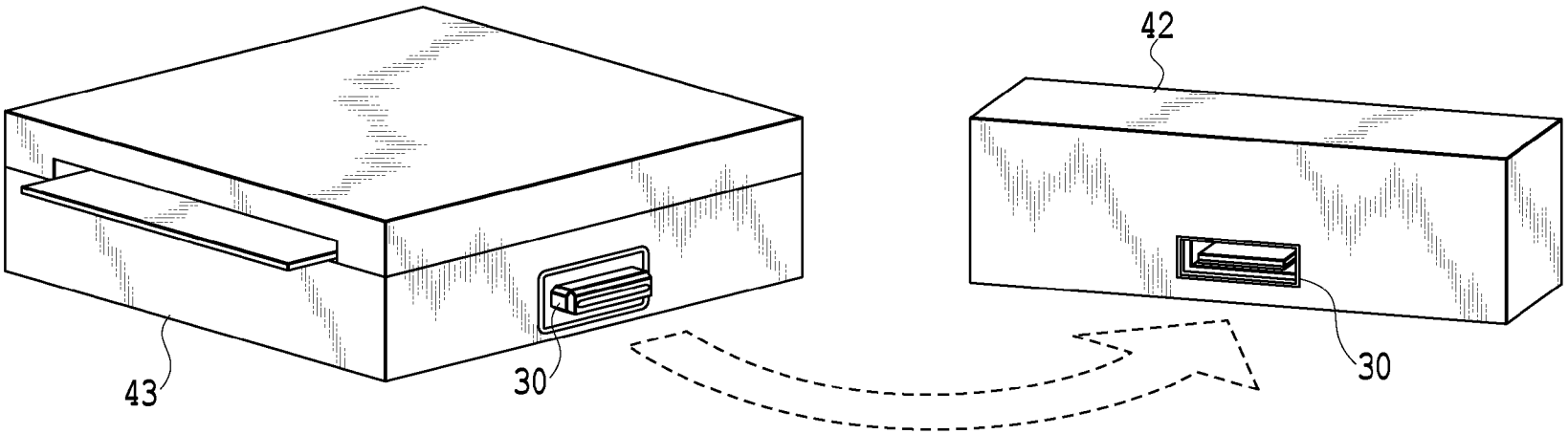
FIG. 5 is a view illustrating a state in which units are attached to or detached from each other via a drawer connector.

As shown in FIG. 5, the heating unit 42 and the conveying unit 43 are electrically connected to each other via a drawer connector 30. Electric power is supplied to the conveying unit 43 via the drawer connector 30. Moreover, a controlling signal line is connected via the drawer connector 30. When the drying unit 8 is installed in the printing apparatus body (in the state shown in FIG. 4A), the two parts of the drawer connector 30 are connected to each other: in contrast, when the drying unit 8 is drawn from the printing apparatus body (in the state shown in FIG. 4B), the two parts of the drawer connector 30 are disconnected from each other. With this configuration, when the drying unit 8 is drawn forward, the heating unit 42 having a high temperature remains inside of the printing apparatus body, and therefore, it is not exposed to the outside. Consequently, the operator can readily shoot a jam trouble with certainty.

The first casing constituent 52 is turned upward (toward the side of the operator) on the hinge 54 on the back in the direction in which the drying unit 8 is drawn, such that the drawn drying unit 8 is opened like a clamshell. The opened first casing constituent 52 is kept opened by an urging mechanism (such as a gas spring, a hinge spring, or a torsion spring). In the first casing constituent 52 are held some parts (i.e., the conveyance belt 34, the heat transmitting plate 38, and the planar heat generator 39) at the upper portion of a sheet conveyance mechanism in the drying unit 8: in contrast, in the second casing constituent 53 are held some parts (i.e., the conveyance rollers 35) at the lower portion of the sheet conveyance mechanism. As a consequence, when the first casing constituent 52 is opened, the sheet conveyance mechanism is separated, and therefore, a sheet S held between the conveyance belt 34 and the conveyance rollers is exposed to the outside, so that the operator can readily remove the sheet S.

Figure 6A:
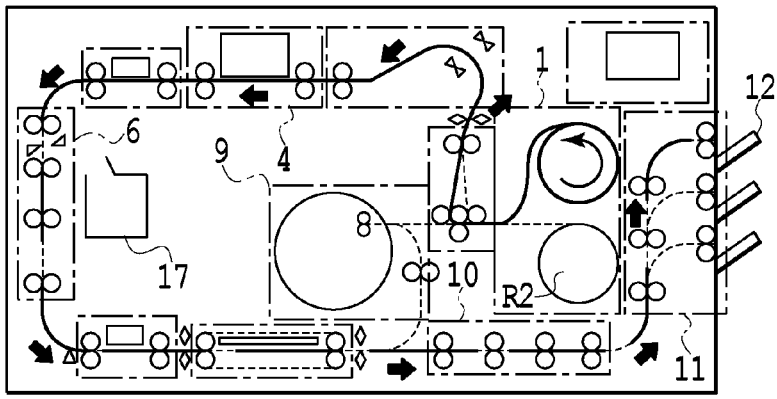
FIG. 6A is a view illustrating a situation in which a jam occurs in a simplex print mode.
Figure 6B:
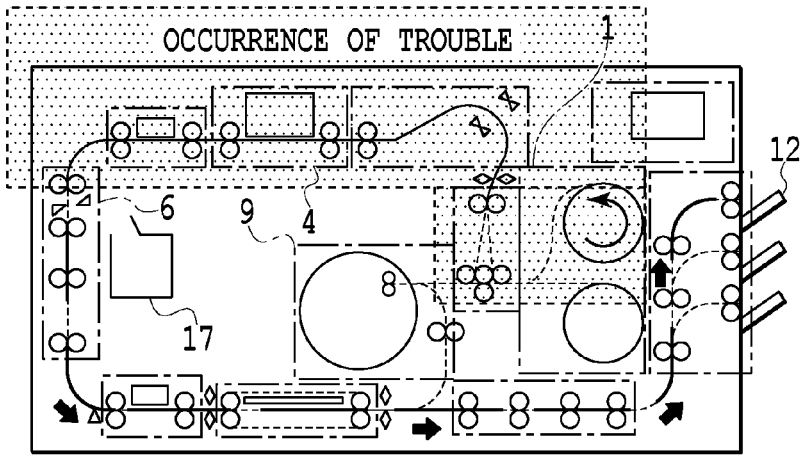
FIG. 6B is another view illustrating the situation in which a jam occurs in the simplex print mode.
Figure 6C:
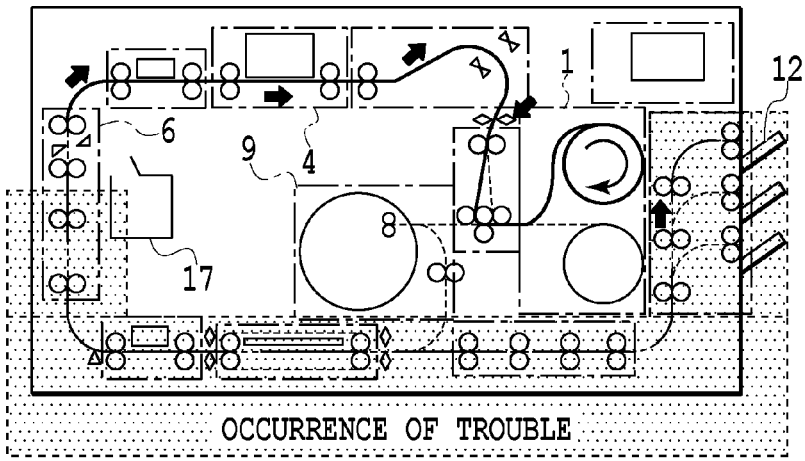
FIG. 6C is a further view illustrating the situation in which a jam occurs in the simplex print mode.
Figure 7A:
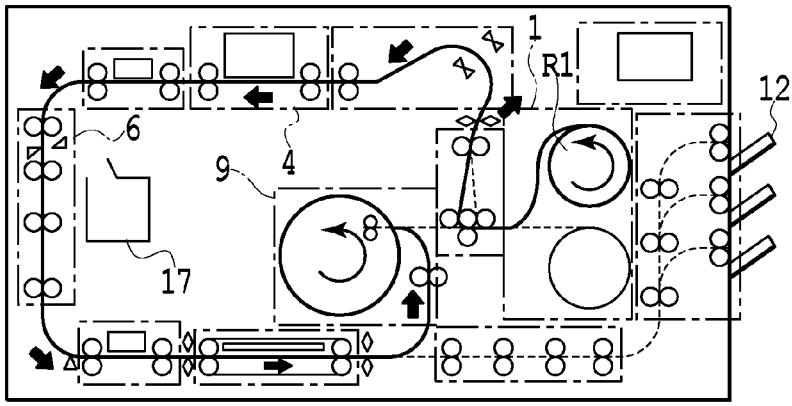
FIG. 7A is a view illustrating a situation in which a jam occurs during obverse printing in a duplex print mode.
Figure 7B:
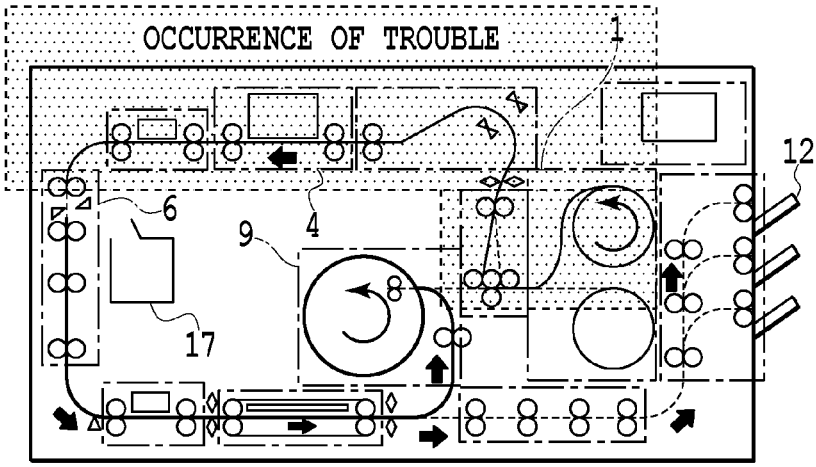
FIG. 7B is another view illustrating the situation in which a jam occurs during the obverse printing in the duplex print mode.
Figure 7C:
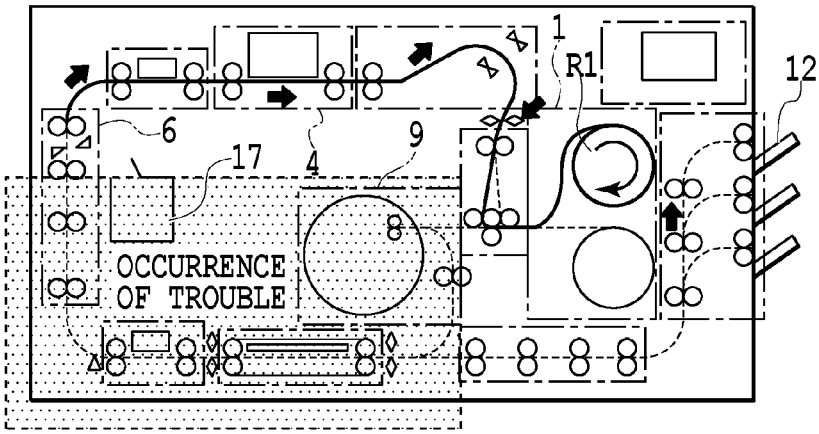
FIG. 7C is a further view illustrating the situation in which a jam occurs during the obverse printing in the duplex print mode.
Figure 8A:
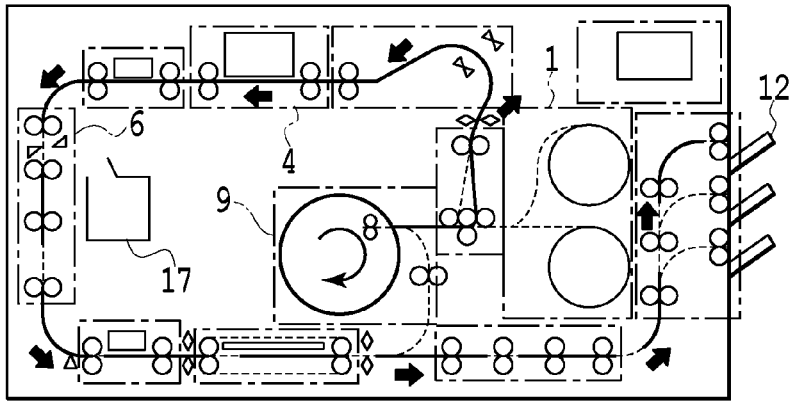
FIG. 8A is a view illustrating a situation in which a jam occurs during reverse printing in the duplex print mode.
Figure 8B:
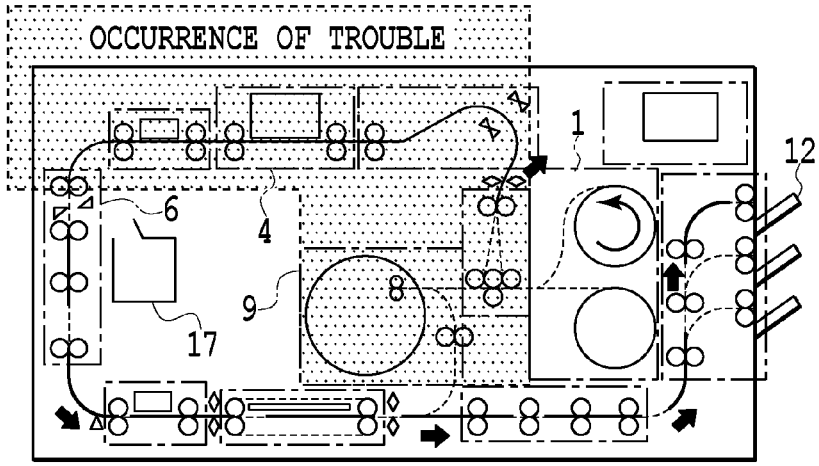
FIG. 8B is another view illustrating the situation in which a jam occurs during the reverse printing in the duplex print mode.
Figure 8C:
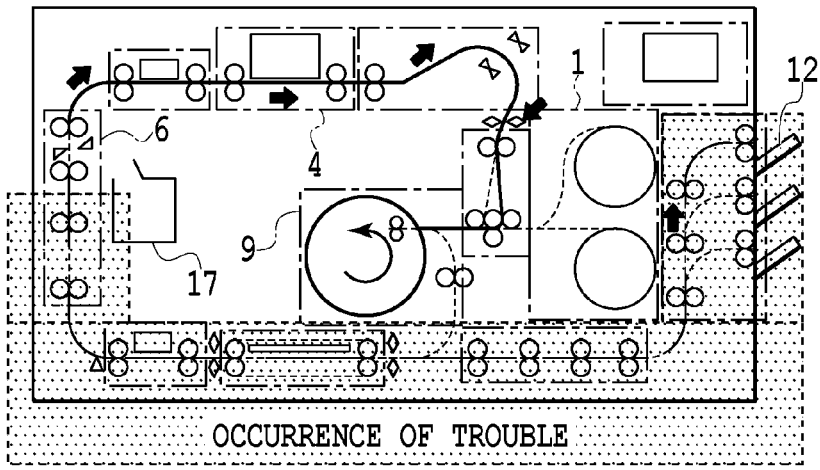
FIG. 8C is a further view illustrating the situation in which a jam occurs during the reverse printing in the duplex print mode.

Next, a description will be given of the state of jam occurrence during the sheet conveyance in the above-described printing apparatus and the following clearing operation. FIG. 6A shows the sheet conveyance state during printing in the simplex print mode; FIG. 6B shows jam occurrence on the path upstream of the cutting unit 6; and FIG. 6C shows jam occurrence on the path downstream of the cutting unit 6. A jam trouble occurs in shaded regions in FIGS. 6B and 6C. The operator needs to remove and discard the sheet jammed in these regions. Moreover, FIG. 7A shows the sheet conveyance state during obverse printing in the duplex print mode; FIG. 7B shows jam occurrence on the path upstream of the cutting unit 6; and FIG. 7C shows jam occurrence on the path downstream of the cutting unit 6. Additionally, FIG. 8A shows the sheet conveyance state during reverse printing in the duplex print mode; FIG. 8B shows jam occurrence on the path upstream of the cutting unit 6; and FIG. 8C shows jam occurrence on the path downstream of the cutting unit 6. A jam trouble occurs in shaded regions in the cases shown in the drawings. The operator needs to remove and discard the sheet jammed in these regions.

The printing apparatus is provided with a jam detecting device for detecting jam occurrence in the sheet conveyance during the printing operation and a jam occurrence position. Examples of jam detecting methods by the use of the jam detecting device include a method for detecting abnormal conveyance at the leading end of the sheet and a method for detecting abnormal conveyance in the middle of the sheet. In the former method, theoretical positional information on the leading end of the sheet, calculated based on the control information on the rollers is compared with a result detected by the sheet sensor interposed between the adjacent rollers. When the sheet sensor detects nothing or the detection is extremely delayed in comparison with a theoretical value for a period of time when the leading end of the sheet is presumed to pass the sensor, jam occurrence is determined. In the meantime, when the continuous sheet is deficiently conveyed at a certain position during the movement of the continuous sheet on the sheet conveyance path, a speed is decreased at that position: it becomes zero in an extreme case. And then, the following sheet is continuously fed at the position at which the speed is decreased, and therefore, the sheet piles up in a looped manner. In contrast, in the latter method, a technique for detecting abnormal conveyance can determine jam occurrence in the case of a decrease in motor rotational speed of the conveyance roller or abnormality of a motor load. Another technique can determine jam occurrence when abnormality of a sheet conveyance speed is detected by a plurality of direct sensors provided at positions on the sheet conveyance path, for directly measuring the movement state of the sheet (i.e., the speed or movement amount) based on displacements of a surface. A further technique can determine jam occurrence when the size of a loop detected by a sensor at a portion at which the sheet intentionally sags in a looped manner on the sheet conveyance path is different from an original size.

The controlling unit stops drive motors for all of the conveyance rollers responsible for the sheet conveyance on the sheet conveyance path when the jam detecting device detects a jam occurrence. This is to limit the jam influences only at the position which the jam occurs so as to suppress the influence from spreading at other positions. And then, the controlling unit displays the jam occurrence position and a work instruction on a display in the operating panel 15 or the host apparatus 16, so as to urge the operator to manually perform a jam troubleshooting operation.

Figure 9:
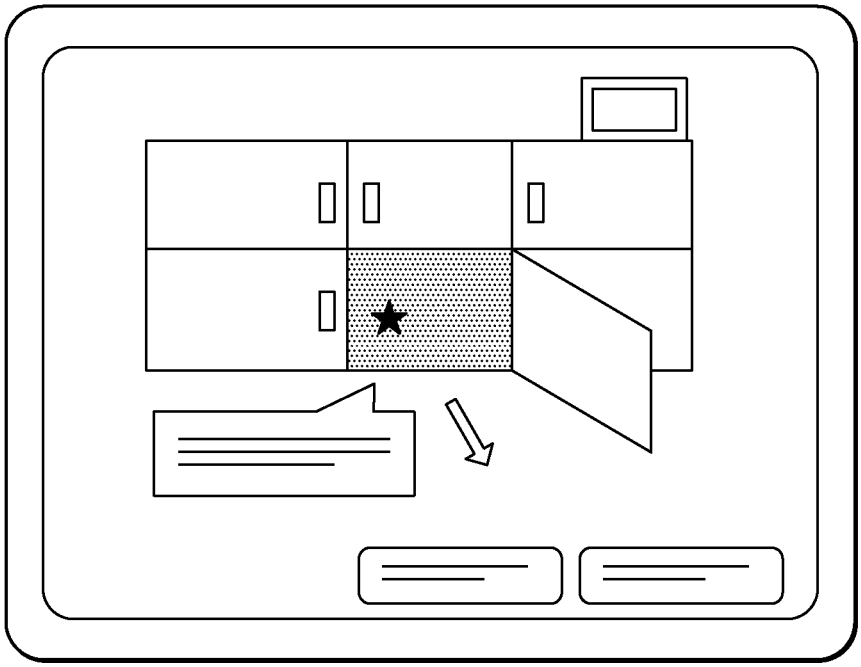
FIG. 9 is a view showing a display example of maintenance information when a jam occurs.

FIG. 9 is a view showing an example in which maintenance information is displayed on the display when a jam occurs. According to the jam occurrence position, a unit to be drawn from the printing apparatus body by the operator, a maintenance door corresponding to the unit, to be opened, and a hand cutter to be operated for cutting the sheet are graphically displayed together with operational procedures. Here, an operational order also is displayed when there are a plurality of maintenance doors to be opened or a plurality of hand cutters to be operated. After receipt of the work instruction, the operator manually shoots the jam trouble for removing the sheet remaining in the trouble occurrence region.

Next, a description will be specifically given of processing in the case of a jam occurrence when the sheet exists between the drying unit 8 (i.e., a first processing unit) and a unit (i.e., a second processing unit) disposed downstream of the drying unit 8. The reversing unit 9 (on the second path) and the discharging/conveying unit 10 (on the third path) are disposed downstream of the drying unit 8. As described above, the path switching mechanism, not shown, selectively switches the second path and the third path. In the following description, a section between the drying unit 8 and the path switching mechanism is commonly referred to as the reversing unit 9.

<Jam Processing During Cut Sheet Conveyance>

First of all, explanation will be made below on the processing in the case where a jam occurs during the cut sheet conveyance. Since the sheet exists between the drying unit 8 and the reversing unit 9 during the cut sheet conveyance, this case corresponds to the cases shown in FIGS. 6A to 6C and 8A to 8C. FIGS. 10A to 14B are cross-sectional views showing the vicinity of the drying unit 8 and the inlet of the reversing unit 9, as viewed from the front side of the apparatus.

In the inlet of the drying unit 8 is disposed a drying unit feeding roller 60: in contrast, in the outlet thereof is disposed a drying unit discharging roller 61 (i.e., a first sheet conveyance mechanism). A jam detecting sensor 62 in the drying unit (i.e., a first detecting device) is interposed between the conveyance belt 34 and the drying unit discharging roller 61. A plurality of reversing unit conveyance rollers 63 are arranged in the reversing unit 9 (i.e., a second sheet conveyance mechanism). The eighth cutter 24 is interposed between the drying unit discharging roller 61 and the reversing unit conveyance roller 63.

Figure 10A:
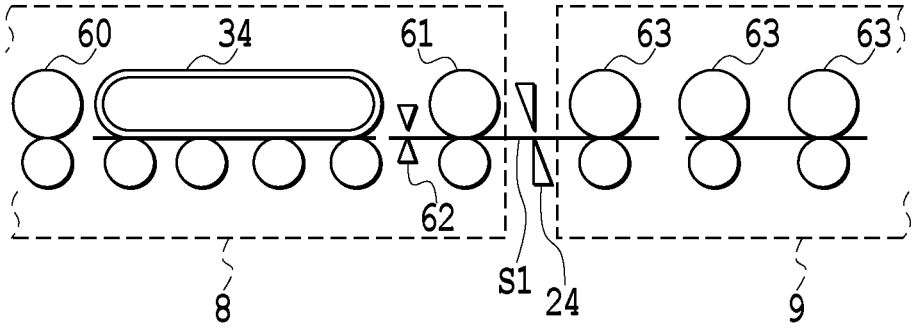
FIG. 10A is a view illustrating a state in which sheet conveyance is stopped in the case where a cut sheet exists.

FIGS. 10A to 14B show the sheet stopped state in the case where cut sheet exists between the drying unit 8 and the reversing unit 9. FIG. 10A shows the state in which a sheet S1 is nipped by the drying unit discharging roller 61 and the reversing unit conveyance roller 63. FIG. 10B shows the state in which the sheet S1 is nipped by the drying unit discharging roller 61, the sheet S1 exists also at the eighth cutter 24, and a sheet S2 conveyed prior to the sheet S1 is nipped by the reversing unit conveyance roller 63. FIG. 10C shows the state in which the sheet S1 is nipped by the drying unit discharging roller 61, the sheet S2 exists at the eighth cutter 24, and the sheet S2 is nipped also by the reversing unit conveyance roller 63.

Figure 10B:
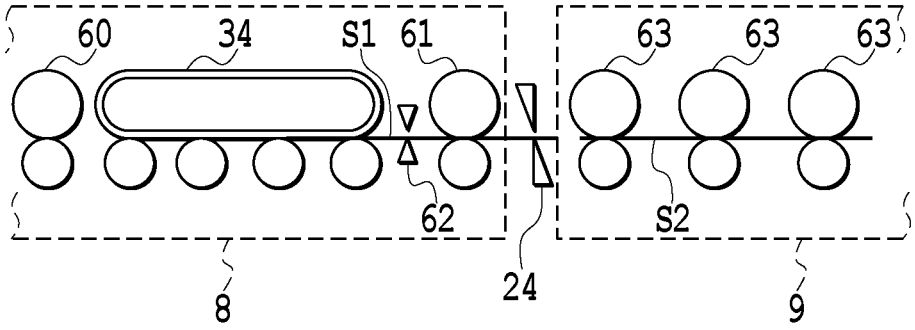
FIG. 10B is another view illustrating the state in which sheet conveyance is stopped in the case where a cut sheet exists.
Figure 10C:
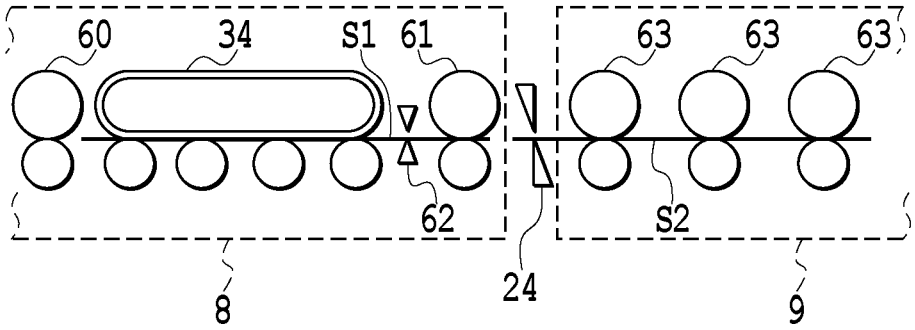
FIG. 10C is a further view illustrating the state in which a sheet conveyance is stopped in the case where a cut sheet exists.

Here, if the operator operates the eighth cutter 24 during the jam trouble shooting in the sheet stopped states shown in FIGS. 10B and 10C, a short sheet piece cut from the sheet is liable to fall and remain in the vicinity of the eighth cutter 24. Since the eighth cutter 24 and the reversing unit 9 are incorporated in the printing apparatus as the units, they cannot be detached by the operator. Therefore, there is a possibility that the operator cannot remove the sheet piece which may remain.

In view of this, in the case where the jam occurs when the sheet exists between the drying unit 8 and the reversing unit 9 in the present preferred embodiment, the sheet conveyance is stopped after jam detection, followed by processing for preventing the sheet piece from remaining inside of the apparatus. This processing will be specifically described below.

Figure 11A:
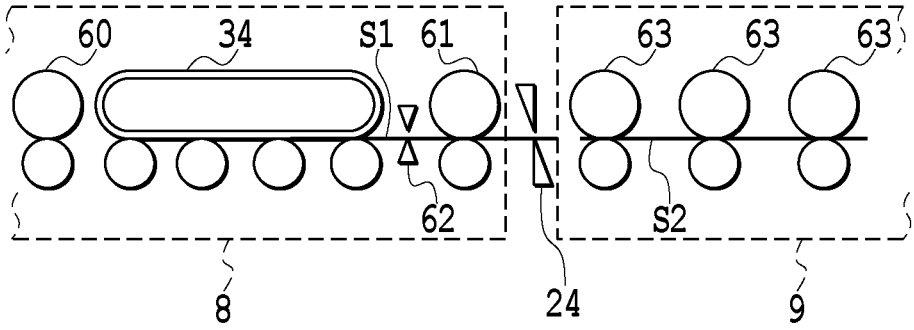
FIG. 11A is a still further view illustrating the state in which sheet conveyance is stopped in the case where a cut sheet exists.
Figure 11B:
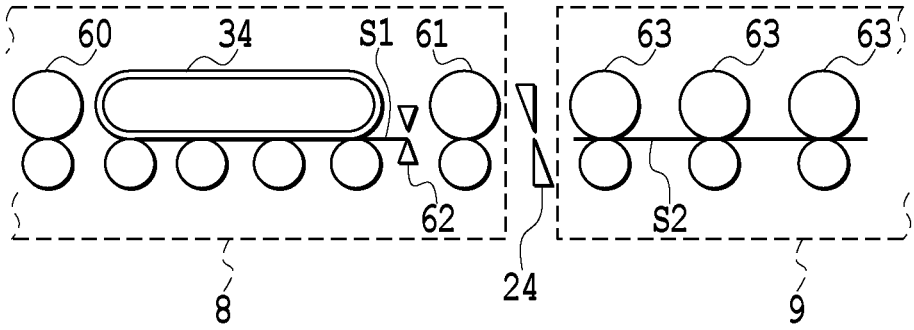
FIG. 11B is a still further view illustrating the state in which sheet conveyance is stopped in the case where a cut sheet exists.

Like FIG. 10B, FIG. 11A shows the state in which the sheet S1 is nipped by the drying unit discharging roller 61, the sheet S1 exists also at the eighth cutter 24, and the sheet S2 conveyed prior to the sheet S1 is nipped by the reversing unit conveyance roller 63. In this state after the detection of the jam occurrence, the sheet conveyance is assumed to be stopped. As described above, if the eighth cutter 24 is operated in this state, the sheet piece remains downstream of the eighth cutter 24 (i.e., on the reversing unit 9 side). In order to prevent such a phenomenon, the conveyance belt 34 in the driving unit for the sheet conveyance in the drying unit 8 and the drying unit discharging roller 61 are driven reversely to the normal sheet conveyance direction. The sheet conveyance direction can be reversed by reversely driving a conveyance driving unit. The sheet is conveyed in the reverse conveyance direction. The sheet staying on the drying unit 8 side is fed back until at least the leading end of the sheet reaches the drying unit 8 side beyond the cutting position by the eighth cutter 24. When the drying unit jam detecting sensor 62 detects the leading end of the sheet S1, the sheet S1 is stopped from being reversely conveyed. This state is shown in FIG. 11B. Even if the hand cutter is operated in this state, no sheet exists at the cutting position, and therefore, no sheet piece is produced.

Figure 12A:
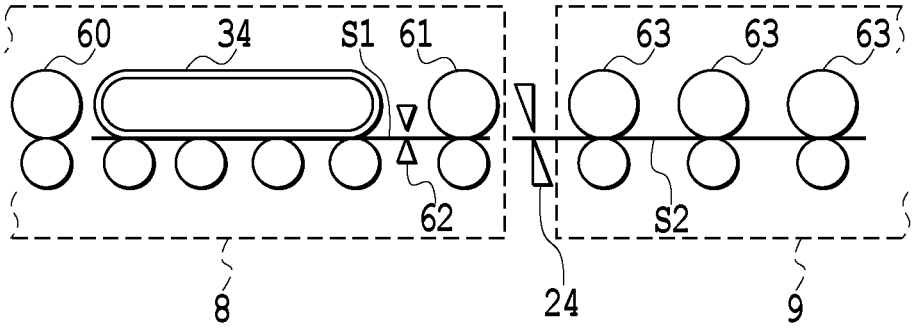
FIG. 12A is a still further view illustrating the state in which sheet conveyance is stopped in the case where a cut sheet exists.
Figure 12B:
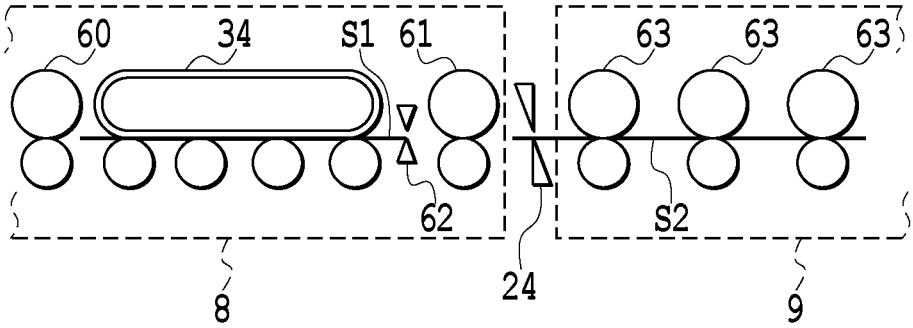
FIG. 12B is a still further view illustrating the state in which sheet conveyance is stopped in the case where a cut sheet exists.
Figure 12C:
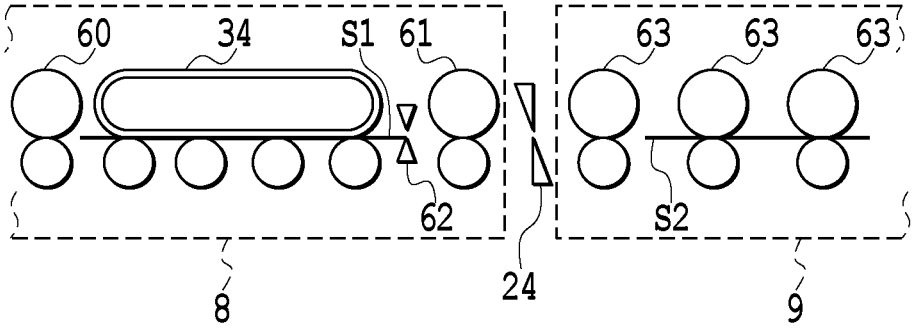
FIG. 12C is a still further view illustrating the state in which sheet conveyance is stopped in the case where a cut sheet exists.

FIG. 12A shows another state in which the conveyance is stopped caused by the jam occurrence. Like FIG. 10C, FIG. 12A shows the state in which the sheet S1 is nipped by the drying unit discharging roller 61, the sheet S2 exists at the eighth cutter 24, and the sheet S2 is nipped also by the reversing unit conveyance roller 63. The sheet conveyance is assumed to be stopped in this state after the detection of the jam occurrence. In this state, if the eighth cutter 24 is operated, the sheet remains upstream of the eighth cutter 24 (i.e., on the drying unit 8 side). First of all, the same processing as that shown in FIG. 11A is performed irrespectively of the sheet stopped state. That is to say, the conveyance belt 34 in the driving unit for the sheet conveyance in the drying unit 8 and the drying unit discharging roller 61 are driven reversely to the normal sheet conveyance direction, thereby conveying the sheet in the reverse conveyance direction. This state is shown in FIG. 12B. In this case, the sheet S1 is conveyed upstream whereas the sheet S2 is not moved. Thereafter, the reversing unit conveyance rollers 63 are driven forward, and thus, the sheet S2 is conveyed downstream by a predetermined amount. The conveyance amount may be any as long as it is equal to or greater than a distance from the drying unit discharging roller 61 to the eighth cutter 24. This state is shown in FIG. 12C. Even if the hand cutter is operated in this state, no sheet exists at the cutting position, and therefore, no sheet piece is produced.

Figure 13A:
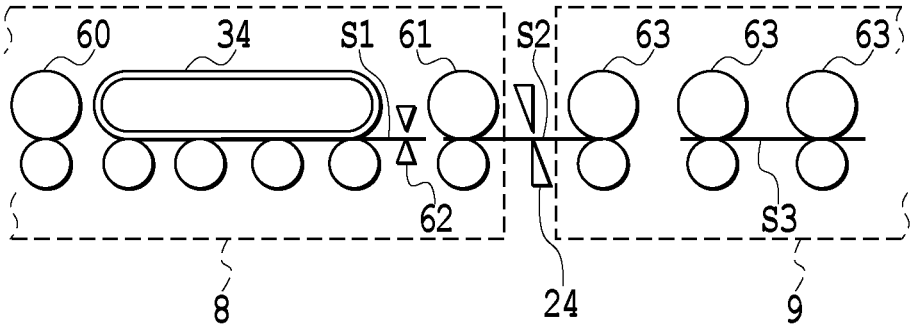
FIG. 13A is a still further view illustrating the state in which sheet conveyance is stopped in the case where a cut sheet exists.
Figure 13B:
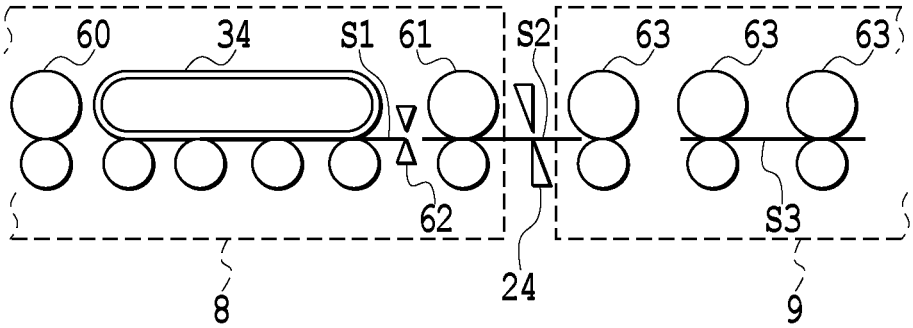
FIG. 13B is a still further view illustrating the state in which sheet conveyance is stopped in the case where a cut sheet exists.

FIG. 13A shows a further state in which the conveyance is stopped caused by the jam occurrence. In this state, the downstream leading end of the sheet S1 exists between the drying unit jam detecting sensor 62 and the drying unit discharging roller 61. The upstream end of the sheet S2 is nipped by the drying unit discharging roller 61 whereas the downstream end thereof is nipped by the reversing unit conveyance roller 63. The sheet conveyance is assumed to be stopped in this state after the detection of the jam occurrence. In the same manner as the above-described case, the conveyance belt 34 in the driving unit for the sheet conveyance in the drying unit 8 and the drying unit discharging roller 61 are driven reversely to the normal sheet conveyance direction, thereby conveying the sheet in the reverse conveyance direction. The nipping force of the drying unit discharging roller 61 is greater than that of the reversing unit conveyance roller 63, and therefore, not only the sheet S1 but also the sheet S2 is conveyed. And then, when the drying unit jam detecting sensor detects the leading end of the sheet S1, the sheet S1 is stopped from being reversely conveyed. This state is shown in FIG. 13B. In this state, the sheet S2 still exists at the cutting position by the eighth cutter 24, and further, the sheet S2 is not nipped downstream by the reversing unit conveyance roller 63. As a consequence, if the eighth cutter 24 is operated, the sheet piece remains in the apparatus.

Figure 13C:
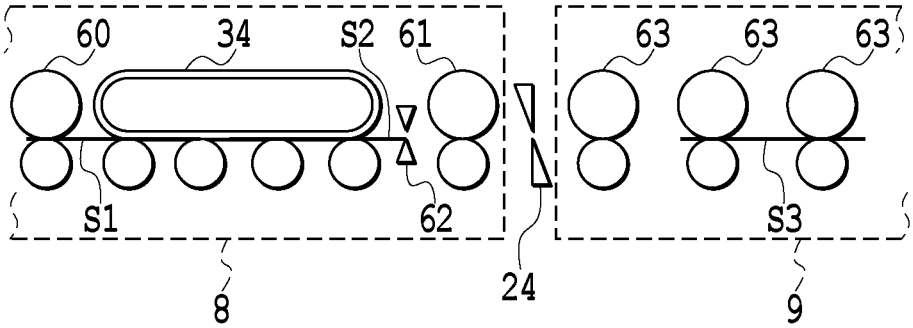
FIG. 13C is a still further view illustrating the state in which sheet conveyance is stopped in the case where a cut sheet exists.

In order to prevent such a phenomenon, in the case where a time after the start of the reverse conveyance till the detection of the leading end of the sheet S1 by the drying unit jam detecting sensor 62 is shorter than a predetermined time (i.e., a first threshold T1), the sheet conveyance mechanism in the drying unit 8 is reversely driven again, and thus, the sheet is further fed back. The predetermined time T1 is obtained by converting the length from the drying unit jam detecting sensor 62 to the drying unit discharging roller 61. As a result of this additional conveyance, when the drying unit jam detecting sensor 62 detects the downstream end of the sheet S2, the sheet conveyance mechanism is stopped from being reversely driven. When the sheet S2 is fed back, the jam detecting sensor 62 detects also the upstream end before detecting the downstream end of the sheet S2. Therefore, the first detection is ignored, and then, the detection is continued. FIG. 13C shows the stopped state in this manner. Even if the eighth cutter 24 is operated in this state, no sheet exists at the cutting position, and therefore, no sheet piece is produced.

Figure 14A:
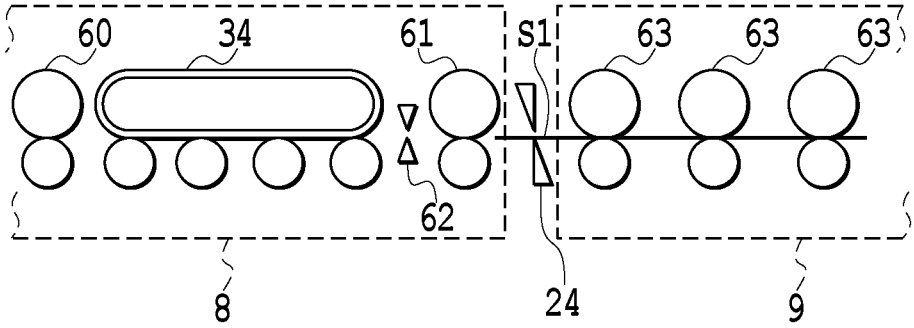
FIG. 14A is a still further view illustrating the state in which sheet conveyance is stopped in the case where a cut sheet exists.
Figure 14B:
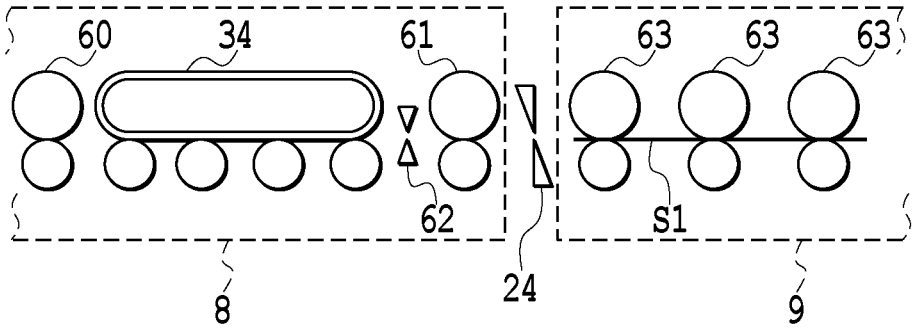
FIG. 14B is a still further view illustrating the state in which sheet conveyance is stopped in the case where a cut sheet exists.

FIG. 14A shows a still further state in which the conveyance is stopped caused by the jam occurrence. Here, the sheet S1 is the last cut sheet, and therefore, there is no subsequent sheet in the drying unit 8. In this case, even if the sheet conveyance mechanism in the drying unit 8 is reversely driven, the drying unit jam detecting sensor 62 cannot detect the leading end of the sheet. Consequently, in the case where the drying unit jam detecting sensor 62 detects nothing after the lapse of another predetermined time (i.e., a second threshold T2) after the start of the reverse driving, the driving is stopped. Thereafter, the reversing unit conveyance rollers 63 are driven forward by a predetermined amount, to be thus turned to the state shown in FIG. 14B. Even if the eighth cutter 24 is operated in this state, no sheet exists at the cutting position, and therefore, no sheet piece is produced.

Figure 15:
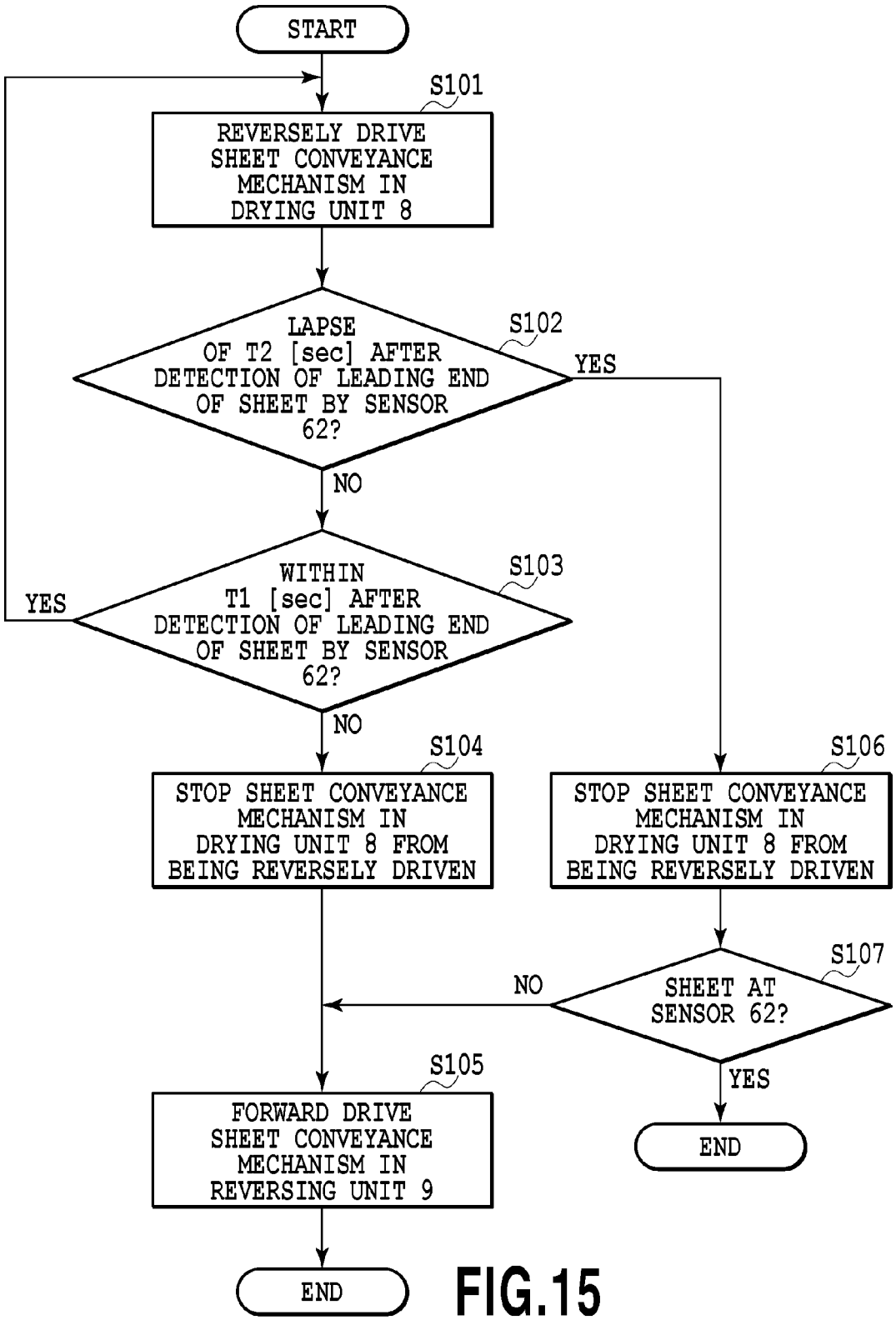
FIG. 15 is a flowchart illustrating jam clearing procedures for the cut sheet.

The procedures of the jam trouble shooting during the above-described cut sheet conveyance are summarized in a flowchart of FIG. 15. First of all, the sheet conveyance mechanism in the drying unit 8 is reversely driven irrespective of the stopped state caused by the jam (step S101). The sheet staying on the drying unit 8 side is fed back until at least the sheet end reaches the drying unit 8 upstream of the cutting position by the eighth cutter 24. If a time till the detection of the sheet end by the drying unit jam detecting sensor 62 is equal to or shorter than T2 [sec] after the sheet conveyance mechanism in the drying unit 8 is started to be reversely driven (step S102) and is equal to or shorter than T1 [sec] (step S103), the sheet conveyance mechanism in the drying unit 8 is continued to be reversely driven (step S101). This routine has been explained with reference to FIGS. 13A to 13C.

If the time till the detection of the sheet end by the drying unit jam detecting sensor 62 is longer than T1 [sec] (step S103), the sheet conveyance mechanism in the drying unit 8 is stopped from being reversely driven (step S104), and then, the sheet conveyance mechanism in the reversing unit 9 is driven forward by the predetermined amount (step S105). This routine has been explained with reference to FIGS. 11A, 11B, and 12A to 12C.

Moreover, in the case where the drying unit jam detecting sensor 62 cannot detect the leading end of the sheet even when the time T2 [sec] is elapsed after the start of the reverse driving of the sheet conveyance mechanism in the drying unit 8 (step S102), the sheet conveyance mechanism in the drying unit 8 is stopped from being reversely driven (step S106). At this time, when there is no sheet in the drying unit jam detecting sensor 62, the reversing unit conveying rollers 63 are driven forward by the predetermined amount, and thus, the control routine comes to an end (steps S107 and S105). This routine has been explained with reference to FIGS. 14A and 14B. In contrast, when there is a sheet in the drying unit jam detecting sensor 62, the state is regarded as conveyance deficiency in which the sheet cannot be fed back, and therefore, the control routine comes to an end (step S107).

Incidentally, when the sheet is fed back by the sheet conveyance mechanism in the drying unit 8, the drying unit feed roller 60 may not be rotated reversely but may remain stopped. If the drying unit feed roller 60 is stopped, the sheets fed back are collected in the drying unit 8, so that the operator can draw the drying unit 8 from the printing apparatus thereafter, and then, can readily draw the sheet from the inside of the unit. The drying unit 8 utilizes the conveyance by the conveyance belt 34, and therefore, the sheet cannot deviate from the surface of the belt during the feedback, thereby suppressing a complicated jam from occurring inside of the drying unit 8.

Hereinafter, a study will be made on the case where a distance between the drive rollers in the unit downstream of the reversing unit 9 is greater than that between the eighth cutter 24 and the reversing unit conveyance roller 63. In this case, even if the drive system in the reversing unit 9 is to be turned by a knob or the like by the operator thereafter such that the sheet is discharged when the eighth cutter 24 is operated in the state in which the sheet leading end is nipped in the most upstream reversing unit conveyance roller 63, the processing may be impossible because the sheet piece remains between the rollers. In order to avoid such a situation, in the state in which the sheet leading end is nipped in the most upstream reversing unit conveyance roller 63, the sheet need be drawn into the drying unit 8 by reversely driving the driving unit for the sheet conveyance in the drying unit 8. As a consequence, it is desired that the conveyance force of the drying unit discharging roller 61 (i.e., the nipping force) should be greater than that of at least the most upstream reversing unit conveyance roller 63 (i.e., the nipping force).

<Jam Clearing During Continuous Sheet Conveyance>

Next, explanation will be made below on processing in the case where a jam occurs during the conveyance of the continuous sheet. The jam clearing processing herein is different from that in the case of the cut sheet.

Figure 16A:
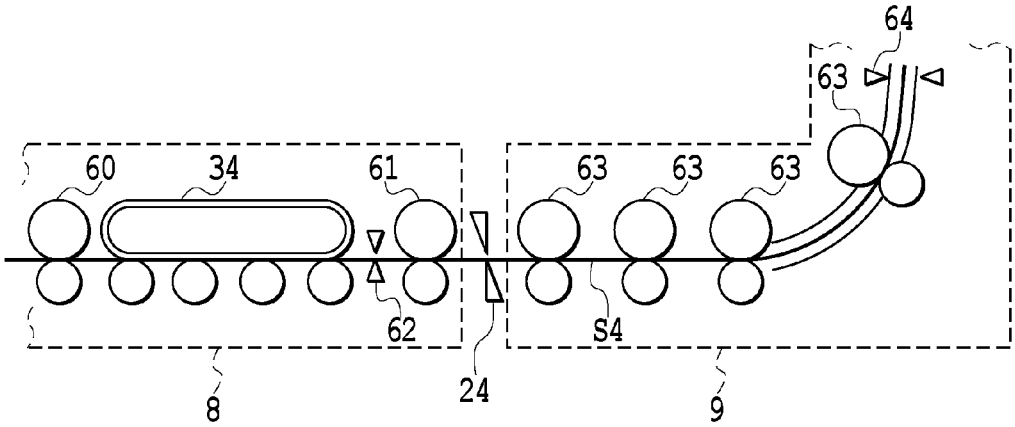
FIG. 16A is a view illustrating a state in which sheet conveyance is stopped in the case where a continuous sheet exists.
Figure 16B:
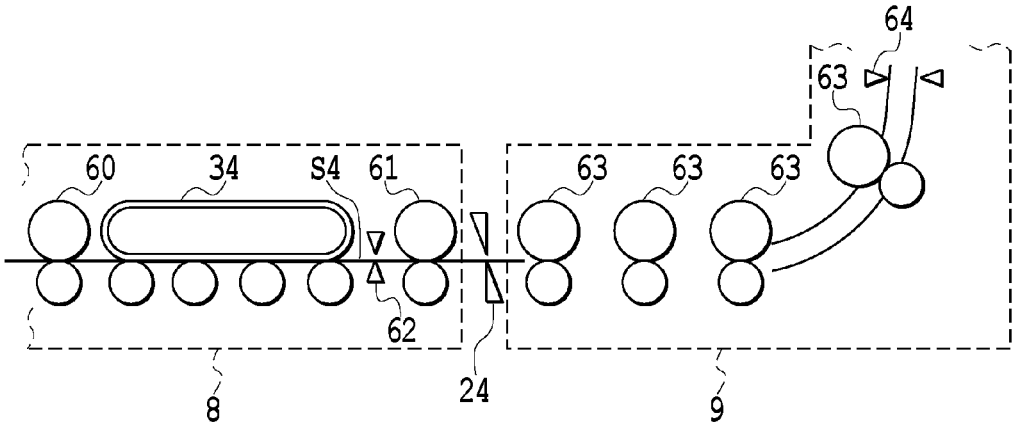
FIG. 16B is another view illustrating the state in which sheet conveyance is stopped in the case where a continuous sheet exists.
Figure 16C:
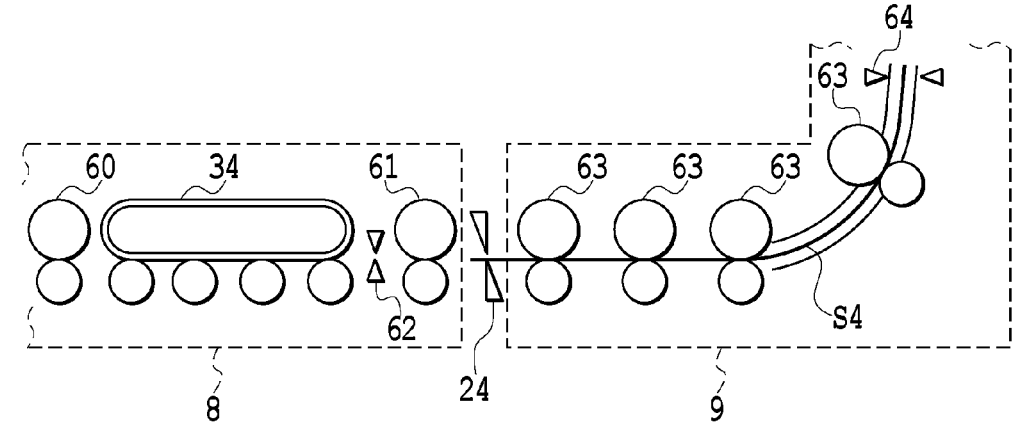
FIG. 16C is a further view illustrating the state in which sheet conveyance is stopped in the case where a continuous sheet exists.

Since the sheet exists between the drying unit 8 and the reversing unit 9 during the conveyance of the continuous sheet, this corresponds to the case shown in FIGS. 7A to 7C. FIGS. 16A to 16C are cross-sectional views showing the drying unit 8 and the reversing unit 9, as viewed from the front side of the apparatus.

The configuration from the drying unit 8 to the inlet of the reversing unit 9 is identical to that shown in FIGS. 10A to 14B. A reversing unit jam detecting sensor 64 is disposed in the subsequent conveying unit (a second detecting device).

In most cases where the continuous sheet exists between the drying unit 8 and the reversing unit 9, a jam occurs in the state in which the sheet exists between the drying unit jam detecting sensor 62 and the reversing unit jam detecting sensor 64, as shown in FIG. 16A. In this case, even if the eighth cutter 24 is operated, no small sheet piece will be produced. The stopped state in which the sheet piece is produced inside of the apparatus by operating the eighth cutter 24 is shown in FIGS. 16B and 16C.

First of all, a description will be given of processing shown in FIG. 16B. The conveyance is stopped after a jam is detected during the conveyance of the continuous sheet, and then, the drying unit jam detecting sensor 62 and the reversing unit jam detecting sensor 64 sense the existence of the sheet therein. In the case where the sheet exists at the drying unit jam detecting sensor 62 whereas no sheet exists at the reversing unit jam detecting sensor 64, the state shown in FIG. 16B is determined. When the eighth cutter 24 is operated in this state, the sheet piece is produced inside of the apparatus. In view of this, the sheet conveyance mechanism in the drying unit 8 is reversely driven, so that the sheet is fed back until at least the sheet end on the drying unit 8 side reaches the drying unit 8 side beyond the cutting position by the eighth cutter 24. The drying unit 8 is reversely driven until the drying unit jam detecting sensor 62 detects the leading end of a sheet S4, and therefore, no sheet exists at the cutting position by the eighth cutter 24. The conveyance force of the drying unit 8 is large enough to pull the sheet nipped by the stopped sheet conveyance mechanism in the reversing unit 9.

Subsequently, a description will be given of processing shown in FIG. 16C. Like the case shown in the FIG. 16B, the drying unit jam detecting sensor 62 and the reversing unit jam detecting sensor 64 sense the existence of the sheet therein. In the case where no sheet exists in the drying unit jam detecting sensor 62 whereas the sheet exists at the reversing unit jam detecting sensor 64, the state shown in FIG. 16C is determined. When the eighth cutter 24 is operated in this state, the sheet piece is produced inside of the apparatus. In view of this, a sheet conveyance mechanism in the reversing unit 9 is driven forward by a predetermined amount, so that the sheet is fed until at least the trailing end of the sheet on the reversing unit 9 side reaches the reversing unit 9 side beyond the cutting position by the eighth cutter 24. Here, the predetermined amount may be any as long as it is equal to or greater than the distance from the drying unit jam detecting sensor 62 to the eighth cutter 24.

Figure 17:
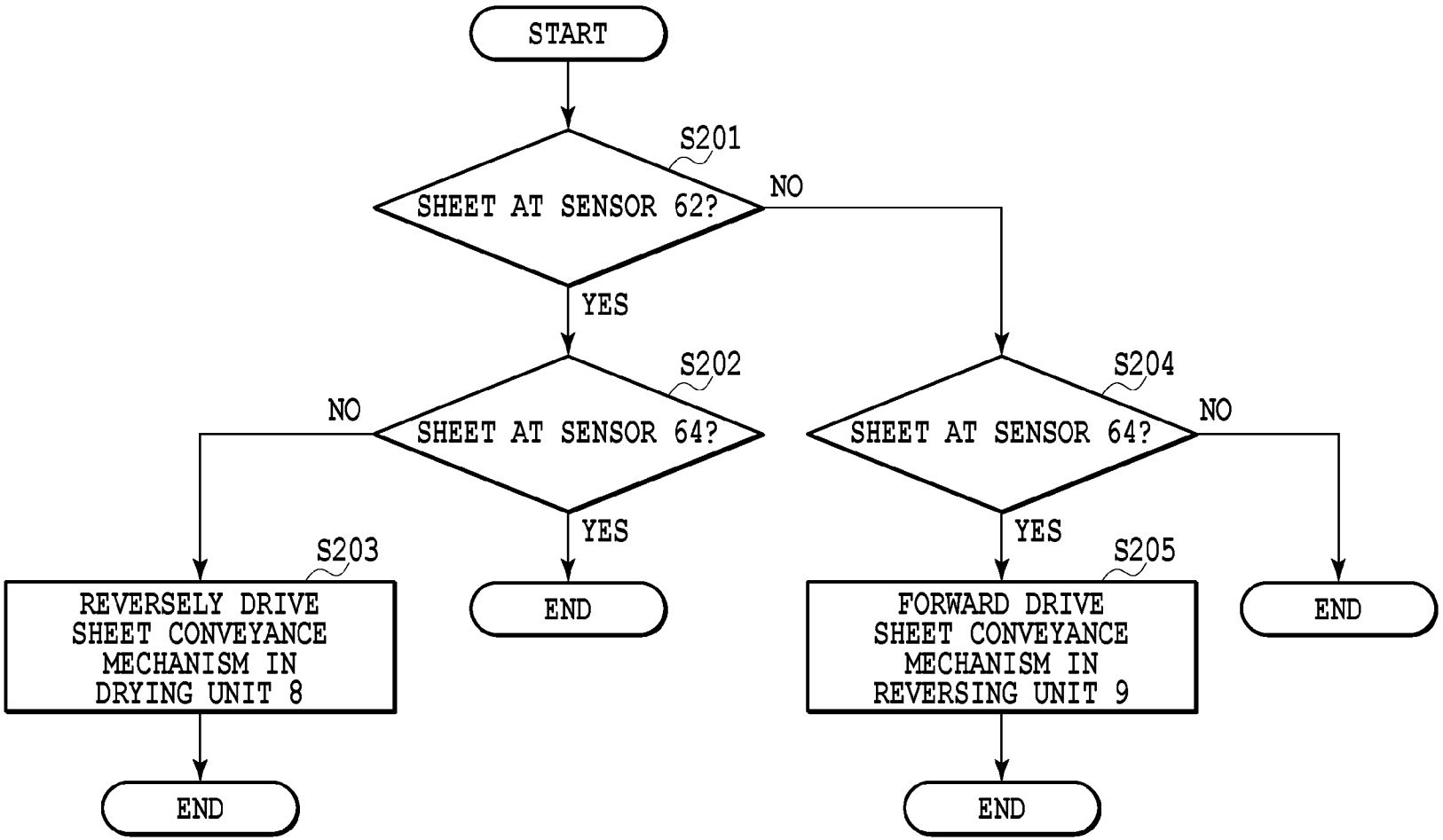
FIG. 17 is a flowchart illustrating jam clearing procedures for a continuous sheet.

The procedures of the jam trouble shooting during the above-described continuous sheet conveyance are summarized in a flowchart of FIG. 17. First of all, the drying unit jam detecting sensor 62 detects the existence of the sheet (step S201). If the sheet exists, the reversing unit jam detecting sensor 64 detects the existence of the sheet (step S202). If the sheet exists, no small sheet piece will be produced even if the eighth cutter 24 is operated, and therefore, there is no possibility of the sheet piece remaining inside of the apparatus. Thus, the operator is instructed to cut the continuous sheet by the eighth cutter 24. In contrast, if no sheet exists, the sheet conveyance mechanism in the drying unit 8 is reversely driven by the predetermined amount (step S203). Moreover, when the drying unit jam detecting sensor 62 does not detect the sheet (step S201), the reversing unit jam detecting sensor 64 detects the existence of the sheet (step S204). If the sheet exists, the sheet conveyance mechanism in the reversing unit 9 is driven forward by the predetermined amount (step S205). If no sheet exists, no small sheet piece will be produced even if the eighth cutter 24 is operated, and therefore, there is no possibility of the sheet piece remaining inside of the apparatus. Consequently, the control routine comes to an end.

Incidentally, the above-described processing may be omitted in the case of the continuous sheet. In the case shown in FIG. 16B, the operator may draw the sheet upstream of the drying unit 8, for example, on the cutting unit 6 side: alternatively, in the case shown in FIG. 16C, the operator may draw the sheet downstream of the reversing unit 9.

In the above-described preferred embodiment, even if the conveyance is stopped when the sheet exists between the first processing unit and the subsequent second processing unit in the case of the jam occurrence during the conveyance of the cut sheet or the continuous sheet, the sheet piece produced by the cutting operation by the cutter can be prevented from falling inside of the apparatus. The sheet recovery is appropriately switched according to whether the sheet to be conveyed is of a cut type or of a continuous type. As a consequence, the jam clearance can be appropriately performed in either mode. Thus, it is possible to simplify the jam clearing procedures by the operator, thereby reducing procedural errors during the jam clearance, and further, increasing the operability of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231517 filed on Oct. 21, 2011, which is hereby incorporated by reference herein in its entirety.

What is claimed is:

1. A sheet conveyance apparatus, comprising:

a first processing unit including a first sheet conveyance mechanism;

a second processing unit including a second sheet conveyance mechanism;

a cutting unit configured to cut a sheet at a cutting position between the first processing unit and the second processing unit;

a first detecting unit, disposed in the vicinity of the first sheet conveyance mechanism, configured to detect the sheet;

a second detecting unit, disposed in the vicinity of the second sheet conveyance mechanism, configured to detect the sheet; and a controlling unit that determines a status of the sheet in a path through the first processing unit and the second processing unit based on detections by the first detecting unit and the second detecting unit, in a case of trouble with sheet conveyance, and drives at least one of the first sheet conveyance mechanism and the second sheet conveyance mechanism based on the determination to allow an end of the sheet to escape from the cutting position.

2. A sheet conveyance apparatus according to claim 1, wherein the controlling unit controls driving of the first sheet conveyance mechanism such that a sheet conveyance direction is a direction away from the second processing unit until the first detecting unit detects the end of the sheet in the case of trouble with sheet conveyance.

3. A sheet conveyance apparatus according to claim 2, wherein the controlling unit, following the driving of the first sheet conveyance mechanism, controls driving of the second sheet conveyance mechanism such that the sheet conveyance direction is a direction away from the first processing unit.

4. A sheet conveyance apparatus according to claim 3, wherein the controlling unit controls driving of the first sheet conveyance mechanism again such that the sheet conveyance direction is a direction away from the second processing unit before the driving of the second sheet conveyance mechanism when a time until the first detecting unit detects the end of the sheet is shorter than a predetermined time.

5. A sheet conveyance apparatus according to claim 2, wherein the controlling unit controls the driving of the first sheet conveyance mechanism to be stopped when the first detecting unit does not detect the end of the sheet irrespective of a lapse of the predetermined time after the start of the driving of the first sheet conveyance mechanism.

6. A sheet conveyance apparatus according to claim 1, wherein the conveyance force of the first sheet conveyance mechanism is greater than that of the second sheet conveyance mechanism.

7. A sheet conveyance apparatus according to claim 1, wherein the first sheet conveyance mechanism includes a plurality of driving units for conveying the sheet, at least one of the plurality of driving units being stopped from driving when the first sheet conveyance mechanism is driven in the case of trouble with sheet conveyance.

8. A sheet conveyance apparatus according to claim 1, wherein the sheet is a continuous type, and the controlling unit determines that, when the first and the second detecting units detect the sheet, the sheet exists in the path through the first processing unit and the second processing unit, and allows the cutter unit to cut the sheet without driving the first and the second sheet conveying units to convey the sheet.

9. A sheet conveyance apparatus according to claim 1, wherein the sheet is a continuous type, and the controlling unit controls driving of the first sheet conveyance mechanism such that the sheet conveyance direction is a direction away from the second processing unit when the first detecting unit detects the sheet whereas the second detecting unit does not detect any sheets.

10. A sheet conveyance apparatus according to claim 1, wherein the sheet is a continuous type, and the controlling unit controls driving of the second sheet conveyance mechanism such that the sheet conveyance direction is a direction away from the first processing unit when the first detecting unit does not detect any sheets whereas the second detecting unit detects the sheet.

11. A printing apparatus, comprising a plurality of processing units including:

a sheet feeding unit that holds and feeds a continuous sheet;

a printing unit that subjects the sheet to printing on a path, on which the sheet is fed from the sheet feeding unit;

a cutting unit that is disposed downstream of the printing unit on the path and cuts the sheet;

a drying unit that is disposed downstream of the cutting unit on the path and dries the sheet subjected to the printing in the printing unit;

a reversing unit that reverses the obverse and reverse of the sheet passing the drying unit, and then, feeds the sheet to the printing unit again; and a discharging unit that discharges the sheet passing the drying unit; and the sheet conveyance apparatus according to claim 1, the first processing unit and the second processing unit being two continuous units on the path out of the plurality of processing units.

12. A printing apparatus according to claim 11, wherein the plurality of processing units further include at least one of a de-curling unit, a skewing correcting unit, an inspecting unit, and an information recording unit.

13. A printing apparatus according to claim 11, wherein the first processing unit can be drawn from an apparatus body for the purpose of maintenance.

14. A jam clearing method in a sheet conveyance apparatus comprising a first processing unit including a first sheet conveyance mechanism, a second processing unit including a second sheet conveyance mechanism, a and a cutting unit configured to cut a sheet at a cutting position between the first processing unit and the second processing unit, the jam clearing method comprising the steps of:

detecting the sheet in the vicinity of the first sheet conveyance mechanism;

detecting the sheet in the vicinity of the second conveyance mechanism;

determining a status of the sheet in a path through the first and the second processing units based on the detections in a case where a sheet conveyance jam has occurred, and driving at least one of the first sheet conveyance mechanism and the second sheet conveyance mechanism based on the determined status to allow an end of the sheet to escape from the cutting position.

15. A jam clearing method in a sheet conveyance apparatus comprising a first processing unit including a first sheet conveyance mechanism, a second processing unit including a second sheet conveyance mechanism, and a cutting unit configured to cut a sheet at a cutting position between the first processing unit and the second processing unit, the jam clearing method comprising the steps of:

detecting the sheet in the vicinity of the first sheet conveyance mechanism;

detecting the sheet in the vicinity of the second conveyance mechanism;

determining a status of the sheet in a path through the first processing unit and the second processing unit based on the detections in a case where a sheet conveyance jam has occurred; and switching processing for sheet recovery to the jam according to the determined status and whether the sheet to be conveyed is of a cut type or of a continuous type.

* * * * *